US006347532B1

(12) United States Patent
Agrawal et al.

(10) Patent No.: US 6,347,532 B1
(45) **Date of Patent: *Feb. 19, 2002**

(54) GAS LIQUEFACTION PROCESS WITH PARTIAL CONDENSATION OF MIXED REFRIGERANT AT INTERMEDIATE TEMPERATURES

(75) Inventors: Rakesh Agrawal, Emmaus; Tamara Lynn Daugherty, Allentown; Mark Julian Roberts, Kempton, all of PA (US)

(73) Assignee: Air Products and Chemicals, Inc., Allentown, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/415,837

(22) Filed: Oct. 12, 1999

(51) Int. Cl.[7] ..... F25J 1/00
(52) U.S. Cl. ..... 62/612; 62/613; 62/619
(58) Field of Search ..... 62/611, 612, 613, 62/619

(56) References Cited

U.S. PATENT DOCUMENTS

| | | | | |
|---|---|---|---|---|
| 3,581,511 A | * | 6/1971 | Peck | 62/612 |
| 3,645,106 A | * | 2/1972 | Gaumer, Jr. et al. | 62/612 |
| 3,763,658 A | | 10/1973 | Gaumer, Jr. et al. | 62/40 |
| 4,065,278 A | | 12/1977 | Newton et al. | 62/26 |
| 4,094,655 A | * | 6/1978 | Krieger | 62/612 |
| 4,112,700 A | | 9/1978 | Forg | 62/28 |
| 4,274,849 A | | 6/1981 | Garier et al. | 62/9 |
| 4,339,253 A | | 7/1982 | Caetani et al. | 62/40 |
| 4,404,008 A | | 9/1983 | Rentler | 62/11 |
| 4,445,916 A | | 5/1984 | Newton | 62/17 |
| 4,504,296 A | | 3/1985 | Newton et al. | 62/31 |
| 4,525,185 A | | 6/1985 | Newton | 62/11 |
| 4,539,028 A | | 9/1985 | Paradowski et al. | 62/9 |
| 4,545,795 A | | 10/1985 | Liu et al. | 62/11 |
| 4,755,200 A | | 7/1988 | Liu et al. | 62/11 |
| 5,943,881 A | | 8/1999 | Grenier | 62/612 |

* cited by examiner

*Primary Examiner*—Ronald Capossela
(74) *Attorney, Agent, or Firm*—John M. Fernbacher

(57) ABSTRACT

Method of producing liquefied natural gas (LNG) whereby refrigeration for cooling and liquefaction is provided by a mixed refrigerant system precooled by another refrigeration system. At least one liquid stream is derived from the partial condensation and separation of the mixed refrigerant at a temperature higher than the lowest temperature provided by the precooling system when the mixed refrigerant is condensed at a final highest pressure. When the mixed refrigerant is condensed at a pressure lower than the final highest pressure, condensation is effected at a temperatures equal or higher than the lowest temperature provided by the precooling system. The mixed refrigerant liquid is used to provide refrigeration at a temperature lower than that provided by the precooling system.

23 Claims, 14 Drawing Sheets

GAS LIQUEFACTION PROCESS WITH PARTIAL CONDENSATION OF MIXED REFRIGERANT AT INTERMEDIATE TEMPERATURES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The liquefaction of natural gas at remote sites, transportation of the liquefied natural gas (LNG) to population centers, and storage and vaporization of LNG for local consumption have been successfully practiced for many years around the world. LNG production sites typically are located on land at remote sites having docking facilities for large LNG tankers which transport the LNG to end users.

Numerous process cycles have been developed for LNG production to provide the large refrigeration requirements for liquefaction. Such cycles typically utilize combinations of single-component refrigeration systems using propane or single chlorofluorocarbon refrigerants operated in combination with one or more mixed refrigerant (MR) systems. Well-known mixed refrigerants typically comprise light hydrocarbons and optionally nitrogen, and utilize compositions tailored to the temperature and pressure levels of specific process steps. Dual mixed refrigerant cycles also have been utilized in which the first mixed refrigerant provides initial cooling at warmer temperatures and the second refrigerant provides further cooling at cooler temperatures.

U.S. Pat. No. 3,763,658 discloses a LNG production system which employs a first propane refrigeration circuit which precools a second mixed component refrigeration circuit. After the final stage of precooling by the first refrigeration circuit, mixed refrigerant from the second refrigeration circuit is separated into liquid and vapor streams. The resulting liquid stream is subcooled to an intermediate temperature, flashed across a throttling valve, and vaporized to provide refrigeration. The resulting vapor stream is liquefied, subcooled to a lower temperature than the intermediate temperature, flashed across a throttling valve, and vaporized to provide refrigeration and final cooling of the feed.

An alternative LNG production system, described in U.S. Pat. No. 4,065,278, uses a first propane refrigeration circuit to precool a second mixed component refrigeration circuit. After the final stage of precooling by the first refrigeration circuit, mixed refrigerant from the second refrigeration circuit is separated into liquid and vapor streams. The resulting liquid stream is subcooled to an intermediate temperature, flashed using a valve and vaporized to provide refrigeration. The resulting vapor stream is liquefied, subcooled to a temperature below the intermediate temperature, flashed across a throttling valve, and vaporized to provide refrigeration and final cooling of the feed. This process differs from U.S. Pat. No. 3,763,658 cited above in that the distillation of the feed for heavy component removal occurs at a temperature lower than that provided by the first refrigeration circuit, and a pressure substantially lower than the feed pressure.

U.S. Pat. No. 4,404,008 discloses a LNG production system which employs a first propane refrigeration circuit to precool a second mixed component refrigeration circuit. After the final stage of precooling by the first refrigeration circuit, mixed refrigerant from the second refrigeration circuit is separated into liquid and vapor streams. The resulting liquid stream is subcooled to an intermediate temperature, flashed using a valve and vaporized to provide refrigeration. The resulting vapor stream is liquefied, subcooled to a temperature lower than the intermediate temperature of the liquid stream, flashed across a throttling valve, and vaporized to provide refrigeration and final cooling of the feed. This prior art differs from U.S. Pat. No. 3,763,658 in that cooling and partial condensation of the mixed refrigerant of the second refrigeration circuit occurs between compression stages. The resulting liquid is then recombined with the resulting vapor stream at a temperature warmer than the lowest temperature of the first refrigeration circuit, and the combined mixed refrigerant stream is then further cooled by the first refrigeration circuit.

An alternative LNG production system is disclosed in U.S. Pat. No. 4,274,849 which system employs a first mixed component refrigeration circuit to precool a second mixed component refrigeration circuit. After the final stage of precooling by the first refrigeration circuit, mixed refrigerant from the second refrigeration circuit is separated into liquid and vapor streams. The resulting liquid stream is subcooled to an intermediate temperature, flashed across a throttling valve, and vaporized to provide refrigeration. The resulting vapor stream is liquefied, subcooled to a temperature lower than the intermediate temperature of the liquid, flashed across a throttling valve, and vaporized to provide refrigeration and final cooling of the feed. In FIG. 7 of this reference, the vapor resulting from the separation of the second refrigerant after precooling is further cooled to a temperature lower than that provided by the first refrigeration circuit and separated into liquid and vapor streams.

U.S. Pat. No. 4,539,028 describes a LNG production system which employs a first mixed component refrigeration circuit to precool a second mixed component refrigeration circuit. After the final stage of precooling by the first refrigeration circuit, mixed refrigerant from the second refrigeration circuit is separated into liquid and vapor streams. The resulting liquid stream is subcooled to an intermediate temperature, flashed across a throttling valve, and vaporized to provide refrigeration. The resulting vapor stream is liquefied, subcooled to a lower temperature than the intermediate temperature, flashed across a throttling valve, and vaporized to provide refrigeration and final cooling of the feed. This patent differs from that of U.S. Pat. No. 4,274,849 described above by the fact that the second refrigerant is vaporized at two different pressures to provide refrigeration.

The state of the art as defined above describes the vaporization of subcooled mixed refrigerant streams to provide refrigeration for natural gas liquefaction wherein the subcooling is provided by a portion of the refrigeration generated by flashing and vaporizing of the subcooled mixed refrigerant streams. Refrigeration for cooling the mixed refrigerant streams and the natural gas feed is provided by the vaporization of mixed refrigerant streams in a main heat exchange zone. Cooling of the mixed refrigerant vapor during and/or after compression is provided by a separate refrigerant such as propane.

Improved efficiency of gas liquefaction processes is highly desirable and is the prime objective of new cycles being developed in the gas liquefaction art. The objective of the present invention, as described below and defined by the claims which follow, is to improve liquefaction efficiency by providing an additional vaporizing refrigerant stream in the main heat exchange zone. Various embodiments are described for the application of this improved refrigeration step which enhance liquefaction efficiency.

BRIEF SUMMARY OF THE INVENTION

The invention relates to a method for providing refrigeration for liquefying a feed gas which comprises:

(1) providing refrigeration from a first recirculating refrigeration circuit which provides refrigeration in a temperature range between a first temperature and a second temperature which is lower than the first temperature;

(2) providing refrigeration from a second recirculating refrigeration circuit in a temperature range between the second temperature and a third temperature which is lower than the second temperature, wherein the first refrigeration circuit provides refrigeration to the second refrigeration circuit in the temperature range between the first temperature and the second temperature;

(3) withdrawing a mixed refrigerant vapor from a main heat exchange zone in the second recirculating refrigeration circuit and compressing the mixed refrigerant vapor to a final highest pressure to yield a compressed mixed refrigerant vapor;

(4) partially condensing at least a portion of the mixed refrigerant vapor in the second recirculating refrigeration circuit and separating the resulting partially condensed mixed refrigerant into at least one liquid refrigerant stream and at least one vapor refrigerant stream; and (5) subcooling the at least one liquid refrigerant stream to a temperature lower than the second temperature, reducing the pressure of the resulting subcooled liquid refrigerant stream, and vaporizing the resulting reduced-pressure refrigerant stream to provide at least a portion of the refrigeration for liquefying the feed gas between the second temperature and the third temperature.

The step of partially condensing the compressed mixed refrigerant vapor is effected at a pressure essentially equal to the final highest pressure.

The refrigeration for liquefying the feed gas between the second temperature and the third temperature can be provided by indirect heat exchange with a vaporizing mixed refrigerant in a main heat exchange zone. This vaporizing mixed refrigerant is provided by (a) compressing the mixed refrigerant vapor to a first pressure;

(b) cooling, partially condensing, and separating the resulting compressed refrigerant vapor to yield a first mixed refrigerant vapor fraction and a first mixed refrigerant liquid fraction;

(c) subcooling the first mixed refrigerant liquid fraction to provide a first subcooled mixed refrigerant liquid;

(d) reducing the pressure of the first subcooled mixed refrigerant liquid and vaporizing the resulting reduced pressure mixed refrigerant liquid in the main heat exchange zone to provide vaporizing mixed refrigerant for cooling and condensing the feed gas therein; and (e) withdrawing a vaporized mixed refrigerant stream from the main heat exchange zone to provide at least a portion of the mixed refrigerant vapor for step (a).

At least a portion of the refrigeration for the subcooling in step (c) can be provided by the vaporizing of the reduced pressure mixed refrigerant in the main heat exchange zone in step (d). At least a portion of the refrigeration for the subcooling in (c) can be provided by indirect heat exchange with one or more additional refrigerant streams external to the main heat exchange zone. The one or more additional refrigerant streams can comprise a single component refrigerant or a multicomponent refrigerant.

The method can further comprise partially condensing and separating the first mixed refrigerant vapor fraction to yield a second mixed refrigerant vapor and a second mixed refrigerant liquid, subcooling the second mixed refrigerant liquid by indirect heat exchange with vaporizing mixed refrigerant in the main heat exchange zone, reducing the pressure of the resulting subcooled second mixed refrigerant liquid, and vaporizing the resulting reduced pressure mixed refrigerant stream in the main heat exchange zone to provide additional vaporizing mixed refrigerant therein.

The method also can further comprise condensing and subcooling the second mixed refrigerant vapor by indirect heat exchange with vaporizing mixed refrigerant in the main heat exchange zone, reducing the pressure of the resulting condensed and subcooled second mixed refrigerant vapor, and vaporizing the resulting reduced-pressure mixed refrigerant stream in the main heat exchange zone to provide additional vaporizing mixed refrigerant therein.

Typically, at least a portion of the refrigeration for the cooling and partial condensing in (b) can be provided by indirect heat exchange with one or more additional refrigerant streams external to the main heat exchange zone. At least one of the one or more additional refrigerant streams can comprise a single component refrigerant a multicomponent refrigerant.

A portion of the refrigeration for cooling the feed gas can be provided by indirect heat exchange with one or more additional refrigerant streams external of the main heat exchange zone. The one or more additional refrigerant streams can comprise a single component refrigerant or a multicomponent refrigerant.

The feed gas can comprise methane and one or more hydrocarbons heavier than methane, and in this case the method can further comprise:

(e) precooling the feed gas by indirect heat exchange with an additional refrigerant stream;

(f) introducing the resulting precooled feed gas into a scrub column with a lean scrub liquid enriched in hydrocarbons heavier than methane;

(g) withdrawing from the bottom of the scrub column a stream rich in hydrocarbons heavier than methane;

(h) withdrawing from the top of the scrub column an overhead stream containing methane and residual hydrocarbons heavier than methane;

(i) cooling the overhead stream in the main heat exchange zone to condense residual hydrocarbons heavier than methane;

(j) separating the resulting cooled overhead stream into a purified methane-enriched product and a stream enriched in hydrocarbons heavier than methane; and (k) utilizing at least a portion of the stream enriched in hydrocarbons heavier than methane to provide the lean scrub liquid of (f).

The first mixed refrigerant vapor fraction can be compressed following separation in (b). The cooling and partially condensing of the resulting compressed first mixed refrigerant vapor in (b) can be effected by indirect heat exchange with a fluid at ambient temperature. A portion of the first mixed refrigerant liquid can be mixed with the first pressurized mixed refrigerant vapor.

Optionally, at least a portion of the first mixed refrigerant vapor in (b) can be further cooled, partially condensed, and separated into an additional mixed refrigerant liquid which is combined with the first pressurized mixed refrigerant liquid. A portion of the refrigeration for cooling and partially condensing the first mixed refrigerant vapor fraction can be provided by indirect heat exchange with vaporizing mixed refrigerant in the main heat exchange zone.

The first pressurized mixed refrigerant liquid after subcooling can be vaporized in the main heat exchange zone at a first pressure and the second pressurized mixed refrigerant liquid after subcooling can be vaporized in the main heat exchange zone at a second pressure. The method can further comprise condensing and subcooling the second mixed refrigerant vapor by indirect heat exchange with vaporizing mixed refrigerant in the main heat exchange zone, reducing the pressure of the resulting condensed and subcooled second mixed refrigerant vapor to the second pressure, and vaporizing the resulting reduced pressure mixed refrigerant liquid in the main heat exchange zone to provide additional vaporizing mixed refrigerant therein.

The operation of the second recirculating refrigeration circuit can include (a) compressing the mixed refrigerant vapor to a first pressure;

(b) cooling, partially condensing, and separating the resulting compressed refrigerant vapor to yield a mixed refrigerant vapor fraction and a mixed refrigerant liquid fraction;

(c) subcooling the mixed refrigerant liquid fraction to provide a subcooled mixed refrigerant liquid;

(d) reducing the pressure of the subcooled mixed refrigerant liquid and vaporizing the resulting reduced pressure mixed refrigerant liquid in the main heat exchange zone to provide one of the vaporizing mixed refrigerant streams for cooling and condensing the feed gas therein; and (e) withdrawing a vaporized mixed refrigerant stream from the main heat exchange zone to provide at least a portion of the mixed refrigerant vapor in (a).

The refrigeration for subcooling the mixed refrigerant liquid fraction can be provided in part by indirect heat exchange with the resulting vaporizing reduced pressure refrigerant liquid in the main heat exchange zone and in part by indirect heat exchange with one or more portions of an additional refrigerant external to the main heat exchange zone.

The operation of the second recirculating refrigeration circuit can further comprise (f) condensing and subcooling the mixed refrigerant vapor fraction to provide an additional subcooled mixed refrigerant liquid; and (g) reducing the pressure of the additional subcooled mixed refrigerant liquid and vaporizing the resulting reduced pressure liquid in the main heat exchange zone to provide another of the vaporizing mixed refrigerant streams for cooling and condensing the feed gas therein.

The refrigeration for condensing and subcooling the additional mixed refrigerant vapor can be provided in part by indirect heat exchange with the resulting vaporizing reduced pressure liquid in the main heat exchange zone and in part by indirect heat exchange with one or more additional refrigerant streams external to the main heat exchange zone.

DETAILED DESCRIPTION OF THE INVENTION

Figure 1:
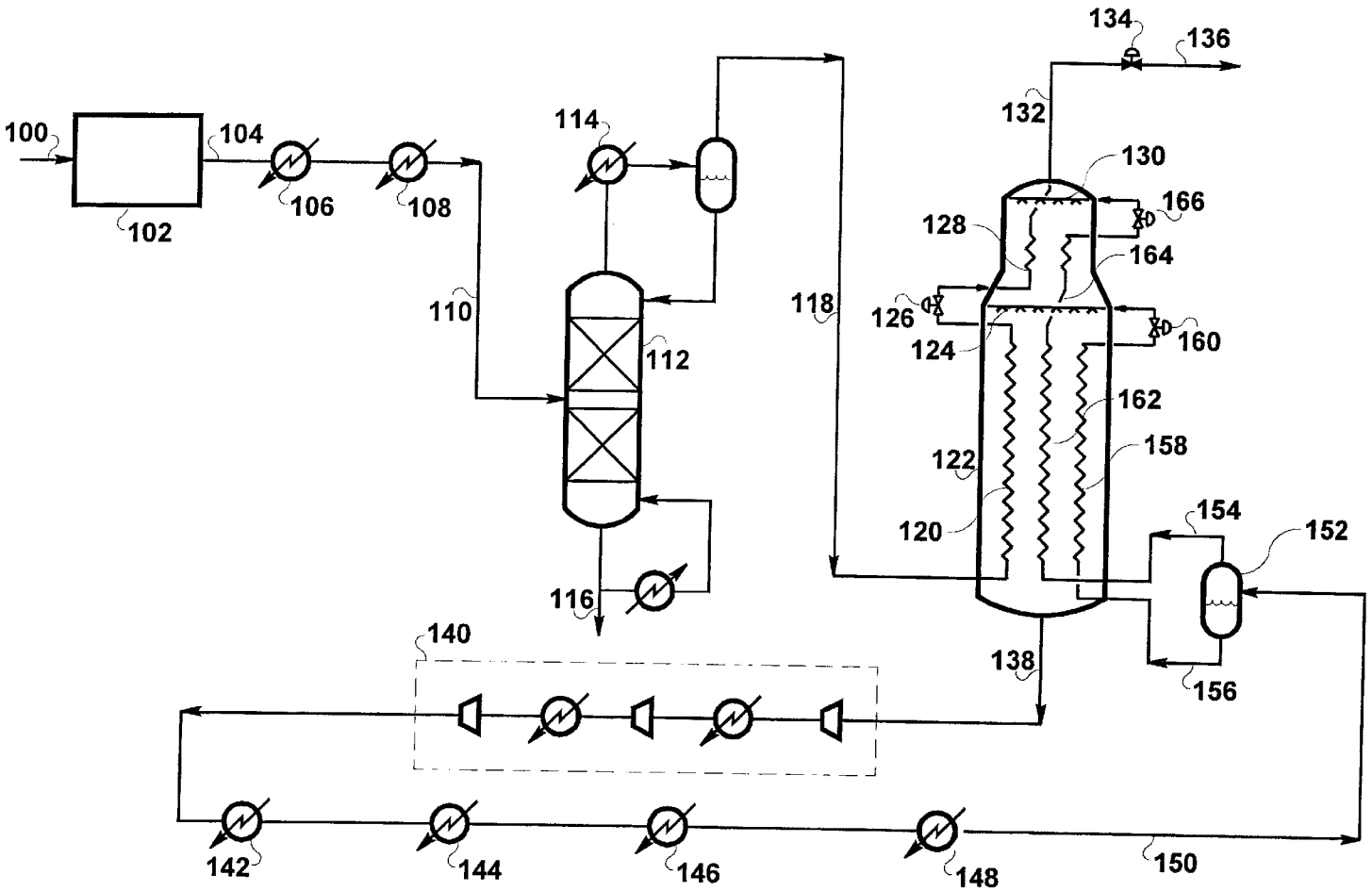
FIGURE 1 Prior Art
FIG. 1 is a schematic flow diagram of a liquefaction process representative of the prior art.

The current invention provides an efficient process for the liquefaction of a gas stream, and is particularly applicable to the liquefaction of natural gas. The invention utilizes a mixed refrigerant system in which the mixed refrigerant after compression is precooled by a second refrigerant system, and at least one liquid stream is derived from the partial condensation and separation of the compressed mixed refrigerant. When the partial condensation step is effected at a pressure less than the final highest pressure of the compressed mixed refrigerant, condensation is carried out at a temperature equal to or higher than the lowest temperature provided by the second refrigerant system. When the partial condensation is effected at a pressure essentially equal to the final highest pressure of the compressed mixed refrigerant, condensation is carried out at a temperature above the lowest temperature provided by the second refrigerant system.

The mixed refrigerant is a multicomponent fluid mixture typically containing one or more hydrocarbons selected from methane, ethane, propane, and other light hydrocarbons, and also may contain nitrogen.

The precooling system generally cools the mixed refrigerant to temperatures below ambient. Although there is no limitation to the lowest temperature achieved by the precooling system in the present invention, it has been found for liquefied natural gas (LNG) production that the lowest precooling temperature should generally be between about 0° C. and about −75° C., and preferably between about −20° C. and about −45° C. The lowest precooling temperature depends on the natural gas composition and LNG product requirements. The precooling system can form a cascade of heat exchangers each employing a single component refrigerant selected from $C_2$–$C_5$ hydrocarbons or $C_1$–$C_4$ halocarbons. If desired, the cooling system can employ a mixed refrigerant comprising various hydrocarbons. One embodiment of the invention utilizes a propane precooled mixed refrigerant system with mixed refrigerant liquid derived after the first stage of propane cooling of the mixed refrigerant, resulting in power savings or increased production over a standard propane precooled mixed refrigerant cycle. Several embodiments are described including the application of the invention to dual mixed refrigerant cycles.

The invention may utilize any of a wide variety of heat exchange devices in the refrigeration circuits including plate-fin, wound coil, shell and tube, and kettle type heat exchangers, or combinations of heat exchanger types depending on specific applications. The invention is applicable to the liquefaction of any suitable gas stream, but is described below as a process for the liquefaction of natural gas. The invention is independent of the number and arrangement of the heat exchangers utilized in the claimed process.

In the present disclosure, the term "heat exchange zone" defines a heat exchanger or combination of heat exchangers in which refrigeration is provided by one or more refrigerant streams to cool one or more process streams within a given temperature range. A heat exchanger is a vessel containing any heat exchange device; such devices can include plates and fins, wound coils, tube bundles, and other known heat transfer means. The term "main heat exchange zone" defines the zone in which refrigeration is provided from the second recirculating refrigeration circuit in a temperature range between the second temperature and the third temperature for cooling and liquefying the feed gas. In the embodiments described below, the main heat exchange zone is a heat exchanger or group of heat exchangers in which refrigeration is provided by the vaporization of a recirculating mixed refrigerant to cool and liquefy the feed gas between the second temperature and the third temperature.

A representative gas liquefaction process according to the prior art is illustrated in FIG. 1. Natural gas 100 is first cleaned and dried in a pretreatment section 102 for the removal of acid gases such as $CO_2$ and $H_2S$ along with other contaminants such as mercury. Pre-treated gas 104 then enters first stage propane exchanger 106 and is cooled therein to a typical intermediate temperature of about 8° C. The stream is further cooled in second stage propane exchanger 108 to a typical temperature of about −15° C., and the resulting further cooled stream 110 enters scrub column 112. In the scrub column, heavier components of the feed, typically pentane and heavier, are removed as stream 116 from the bottom of the scrub column. The scrub column condenser is refrigerated by propane exchanger 114. Propane exchangers 106, 108, and 114 employ vaporizing propane to provide refrigeration by indirect heat exchange.

Natural gas stream 118 after heavy component removal is at a typical temperature of about −35° C. Stream 118 is further cooled in cooling circuit 120 in the first zone of main heat exchanger 122 to a typical temperature of about −100° C. by a boiling mixed refrigerant stream supplied via line 124. The resulting cooled feed gas stream is flashed across valve 126 and is further cooled in cooling circuit 128 in a second zone of main exchanger 122 by boiling mixed refrigerant stream supplied via line 130. The resulting liquefied stream 132 may be flashed across valve 134 to yield final LNG product stream 136 at a typical temperature of −166° C. If necessary, stream 132 or stream 136 can be processed further for the removal of residual contaminants such as nitrogen.

Vaporizing refrigerant streams 124 and 130 flow downward through heat exchanger 122, and combined mixed refrigerant vapor stream 138 is withdrawn therefrom. Mixed refrigerant vapor stream 138 is compressed to a typical pressure of 50 bara in multi-stage compressor 140, is cooled against an ambient heat sink in exchanger 142, and is further cooled and partially condensed against vaporizing propane in heat exchangers 144, 146, and 148 to yield two-phase mixed refrigerant stream 150 at a typical temperature of −35° C.

Two-phase mixed refrigerant stream 150 is separated in separator 152 to yield vapor stream 154 and liquid stream 156 which flow into heat exchanger 122. Liquid stream 156 is subcooled in cooling circuit 158 and flashed across valve 160 to provide a vaporizing refrigerant stream via line 124. Vapor stream 154 is condensed and subcooled in cooling circuits 162 and 164, and is flashed across valve 166 to provide the vaporizing mixed refrigerant stream via line 130.

Figure 2:
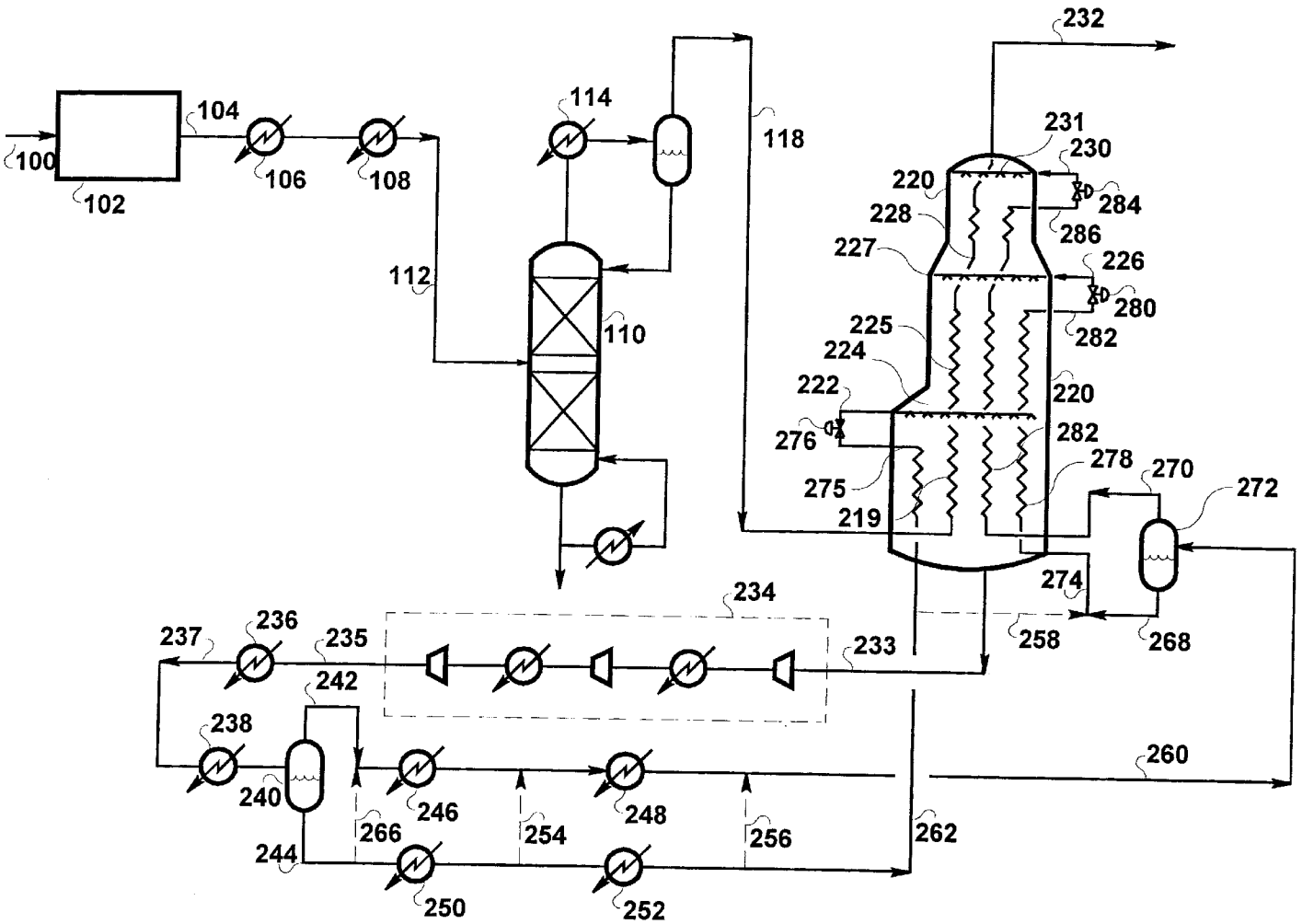
FIG. 2 is a schematic flow diagram of an embodiment of the of the present invention in which compressed mixed refrigerant is partially condensed at an intermediate temperature following cooling in one stage of heat exchange with a second refrigerant.

A preferred embodiment of the present invention is illustrated in FIG. 2. Natural gas feed stream 118, after heavy component removal and cooling to about −35° C., is provided as described above with respect to FIG. 1. Stream 118 is cooled further in cooling circuit 219 in the lower zone of heat exchanger 220 to a typical temperature of about −100° C. by indirect heat exchange with a first vaporizing mixed refrigerant introduced via lines 222 and 224. Heat exchanger 222 is the main heat exchange zone earlier defined wherein refrigeration is provided by one or more refrigerant streams to cool a process stream within a given temperature range. The gas stream is further cooled to a typical temperature of about −130° C. in cooling circuit 225 in the middle zone of heat exchanger 220 by indirect heat exchange with a second vaporizing mixed refrigerant introduced via lines 226 and 227. The resulting stream then is further cooled to a typical temperature of about −166° C. in cooling circuit 228 in the upper zone of heat exchanger 220 by indirect heat exchange with a third vaporizing mixed refrigerant introduced via lines 230 and 231. Final LNG product is withdrawn as stream 232 and sent to a storage tank or to further processing if required.

In the process of FIG. 2, when very low levels of heavy components are required in the final LNG product, any suitable modification to scrub column 110 can be made. For example, a heavier component such as butane may be used as the wash liquid.

Refrigeration to cool and condense natural gas stream 118 from about −35° C. to a final LNG product temperature of about −166° C. is provided at least in part by a mixed refrigerant circuit utilizing a preferred feature of the present invention. Combined vaporized mixed refrigerant stream 233 is withdrawn from the bottom of heat exchanger 220 and compressed in multistage compressor 234 to a typical pressure of about 50 bara. Compressed refrigerant 235 is then cooled against an ambient heat sink in exchanger 236 to about 30° C. Initially cooled high pressure mixed refrigerant stream 237 is further cooled and partially condensed in first stage propane exchanger 238 at a temperature of approximately 8° C. The partially condensed stream flows into separator 240 where it is separated into vapor stream 242 and liquid stream 244. Vapor stream 242 is further cooled in propane exchanger 246 to a temperature of approximately −15° C. and is further cooled in propane exchanger 248 to about −35° C. Liquid stream 244 is further cooled in propane exchanger 250 to a temperature of approximately −15° C. and is further cooled in propane exchanger 252 to about −35° C. to provide subcooled refrigerant liquid stream 262.

After separation in separator 240, a portion of liquid stream 244 may be blended with the vapor at any point before, during, or after the cooling steps as represented by optional streams 254, 256, and 266. The resulting two-phase refrigerant stream 260 is then separated into liquid and vapor streams 268 and 270 in separator 272. Optionally, a portion of subcooled liquid stream 262 as stream 258 may be blended with saturated liquid stream 268 to yield liquid refrigerant stream 274.

Three mixed refrigerant streams enter the warm end of heat exchanger 220 at a typical temperature of about −35° C.: heavy liquid stream 262, lighter liquid stream 274, and vapor stream 270. Stream 262 is further subcooled in cooling circuit 275 to a temperature of about −100° C. and is reduced in pressure adiabatically across Joule-Thomson throttling valve 276 to a pressure of about 3 bara. The reduced-pressure refrigerant is introduced into exchanger 220 via lines 222 and 224 to provide refrigeration as earlier described. If desired, the refrigerant stream may be reduced in pressure by work expansion using a turboexpander or expansion engine in place of throttling valve 276. Liquid refrigerant stream 274 is subcooled in cooling circuit 278 to a temperature of about −130° C. and is reduced in pressure adiabatically across Joule-Thomson throttling valve 280 to a pressure of about 3 bara. The reduced-pressure refrigerant is introduced into exchanger 220 via lines 226 and 227 to provide refrigeration therein as earlier described. If desired, the refrigerant stream may be reduced in pressure by work expansion using a turboexpander or expansion engine in place of throttling valve 280.

Refrigerant vapor stream 270 is liquefied and subcooled in cooling circuit 282 to a temperature of about −166° C. and is reduced in pressure adiabatically across Joule-Thomson throttling valve 284 to a pressure of about 3 bara. The reduced-pressure refrigerant is introduced into exchanger 220 via lines 230 and 231 to provide refrigeration therein as earlier described. If desired, the refrigerant stream may be reduced in pressure by work expansion using a turboexpander or expansion engine in place of throttling valve 284.

In the process of FIG. 2, some heat exchangers may be combined into one heat exchanger if desired. For example, heat exchangers 246 and 250 could be combined, or heat exchangers 246 and 248 could be combined.

While the preferred embodiment in FIG. 2 is described using typical temperatures and pressures of various streams, these pressures and temperatures are not intended to be limiting and may vary widely depending on design and operating conditions. For example, the pressure of the high pressure mixed refrigerant may be any suitable pressure and not necessarily 50 bara, and the pressure of the low pressure pressure mixed refrigerant stream 233 could be any suitable pressure between 1 bara and 25 bara. Similarly, the typical temperatures given above in describing the process may vary and will depend on specific design and operating conditions.

Thus an important feature of the present invention is the generation of additional subcooled liquid refrigerant stream 262, which is further subcooled and vaporized to provide refrigeration in the bottom section of heat exchanger 220. The use of this additional refrigerant stream results in power savings by reducing the total amount of required subcooling of liquid streams. Utilization of liquid refrigerant stream 262, which contains heavier hydrocarbon components, provides a thermodynamically preferred composition for vaporization in the bottom or warm zone of heat exchanger 220. The condensation and separation of heavier refrigerant stream 262 results in a higher concentration of lighter components in liquid refrigerant stream 274, which is more appropriate for providing refrigeration in the middle zone of heat exchanger 220. The use of optimum compositions of refrigerant streams 262 and 274 yields better cooling curves and improved efficiency in heat exchanger 220.

Figure 3:
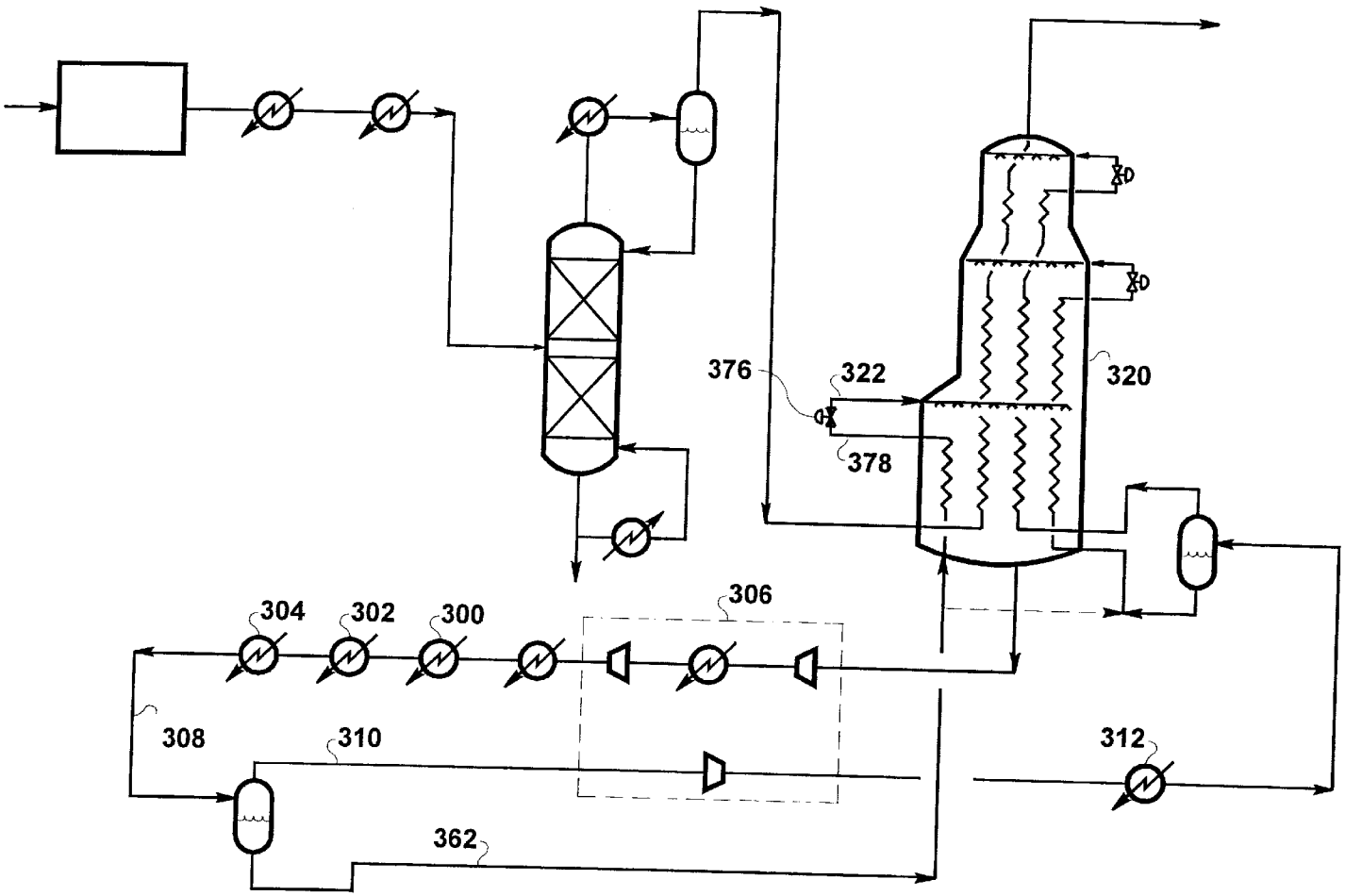
FIG. 3 is a schematic flow diagram of another embodiment of the present invention in which compressed mixed refrigerant is partially condensed at an intermediate temperature following cooling in three stages of heat exchange with a second refrigerant and at an intermediate pressure below the final pressure of the compressed mixed refrigerant vapor.

Another embodiment of the invention is illustrated in FIG. 3. In this embodiment, three stages of propane precooling are provided by exchangers 300, 302, and 304 between the compression stages of compressor 306. After the final stage of propane precooling, partially condensed stream 308 is separated into vapor stream 310 and liquid stream 362. Vapor stream 310 is further compressed to the final high pressure in an additional stage or stages in compressor 306, and optionally is further cooled in propane precooling exchanger 312. Liquid stream 362 is subcooled, reduced in pressure adiabatically across throttling valve 376, and introduced into heat exchanger 320 via line 322 to provide refrigeration as earlier described with reference to FIG. 2. If desired, the pressure of stream 378 could be reduced by work expansion using a turboexpander or expansion engine in place of throttling valve 376.

Figure 4:
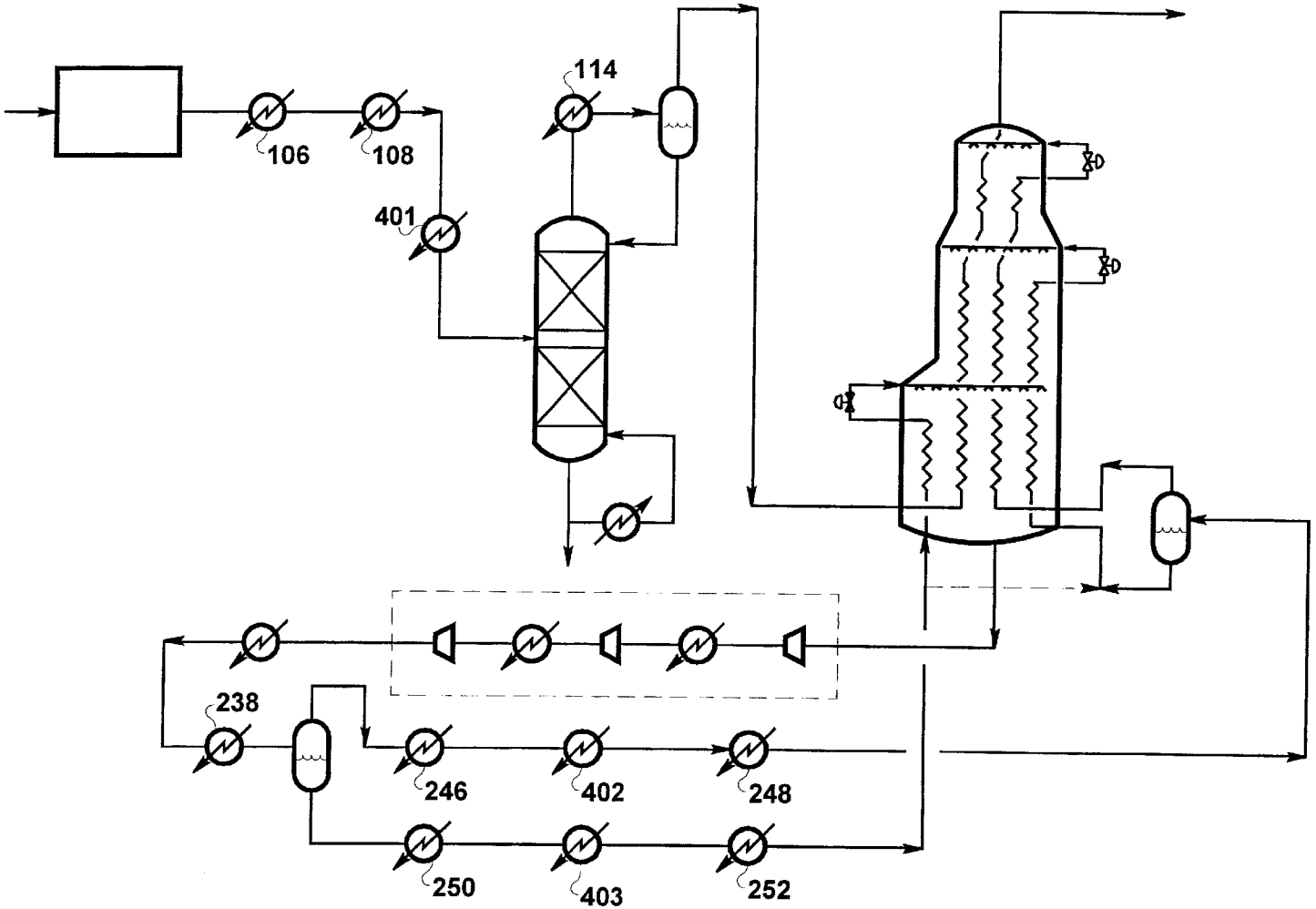
FIG. 4 is a schematic flow diagram of another embodiment of the present invention in which intermediate mixed refrigerant vapor and liquid streams are further cooled in three stages of heat exchange with a second refrigerant.

Another embodiment of the invention is illustrated in FIG. 4. In this embodiment, four stages of propane precooling are employed for feed precooling and pretreatment, shown as earlier-described feed heat exchangers 106, 108, 114, and additional exchanger 401, respectively. Additional propane refrigeration also is used for cooling the mixed refrigerant circuit, wherein exchangers 402 and 403 are used with previously-described exchangers 246, 248, 250, and 252. The additional exchangers add some complication but improve the efficiency of the liquefaction process.

Figure 5:
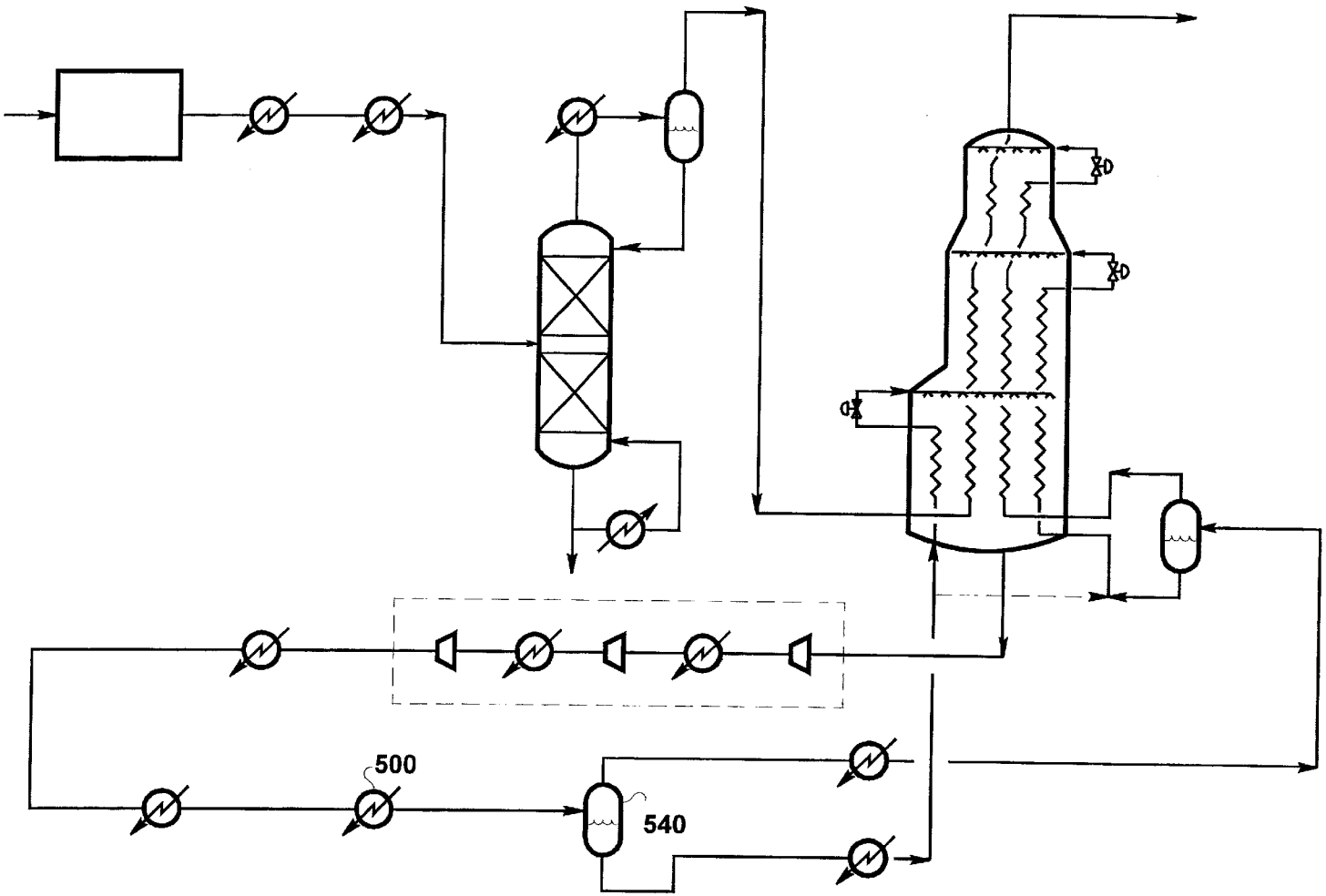
FIG. 5 is a schematic flow diagram of another embodiment of the present invention in which compressed mixed refrigerant is partially condensed at an intermediate temperature following cooling in two stages of heat exchange with a second refrigerant.
Figure 6:
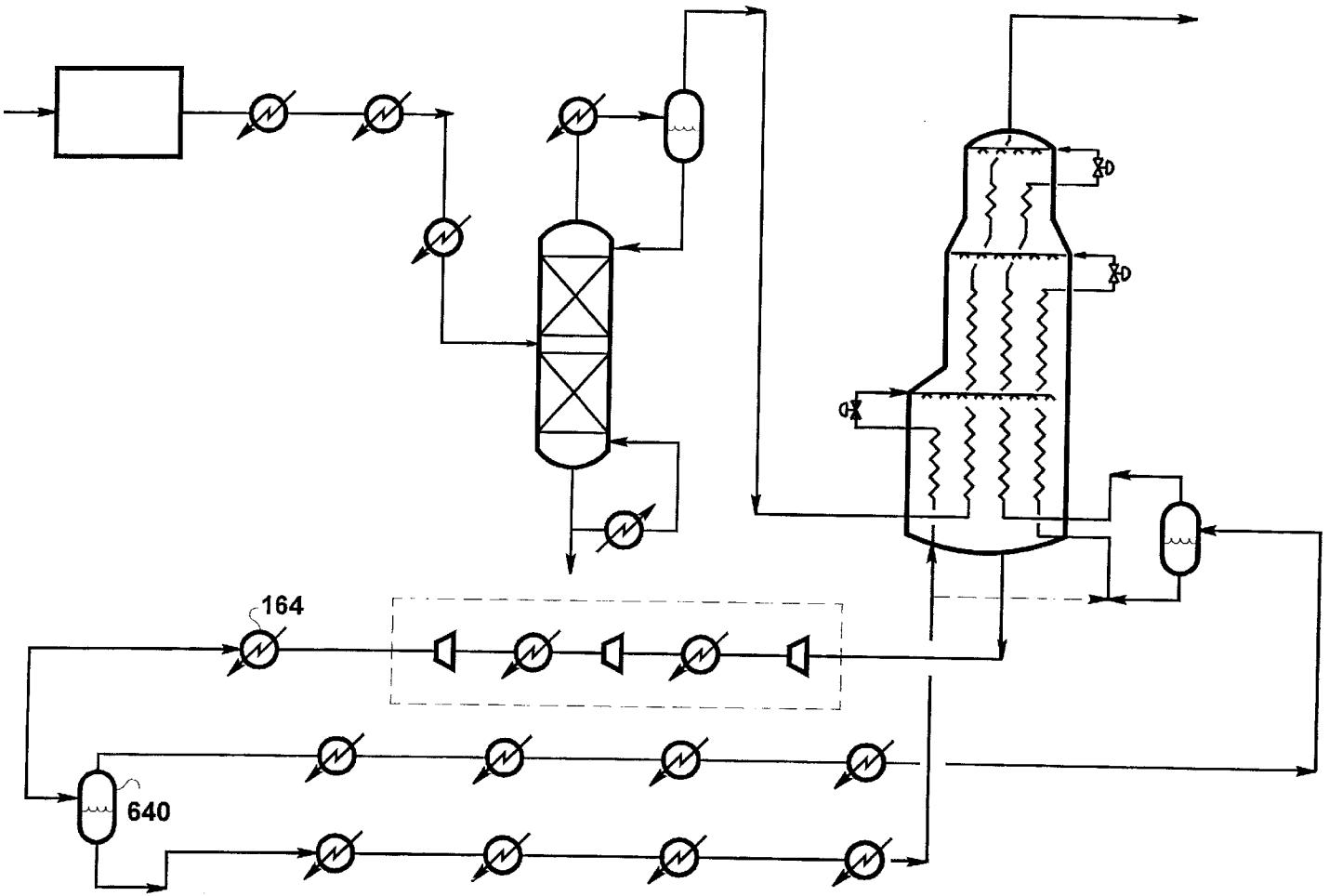
FIG. 6 is a schematic flow diagram of another embodiment of the present invention in which intermediate mixed refrigerant vapor and liquid streams are further cooled in four stages of heat exchange with a second refrigerant.

Another embodiment of the invention is illustrated in FIG. 5 wherein the first separator 540 is located after the second stage of propane precooling 500 rather than after the first stage of propane precooling as in the embodiment of FIG. 2. FIG. 6 shows another optional embodiment wherein the first separator 640 is located immediately after ambient cooler 164 rather than after the first stage of propane precooling in the embodiment of FIG. 2. In the embodiment of FIG. 6, all propane cooling is carried out after separator 640.

Figure 7:
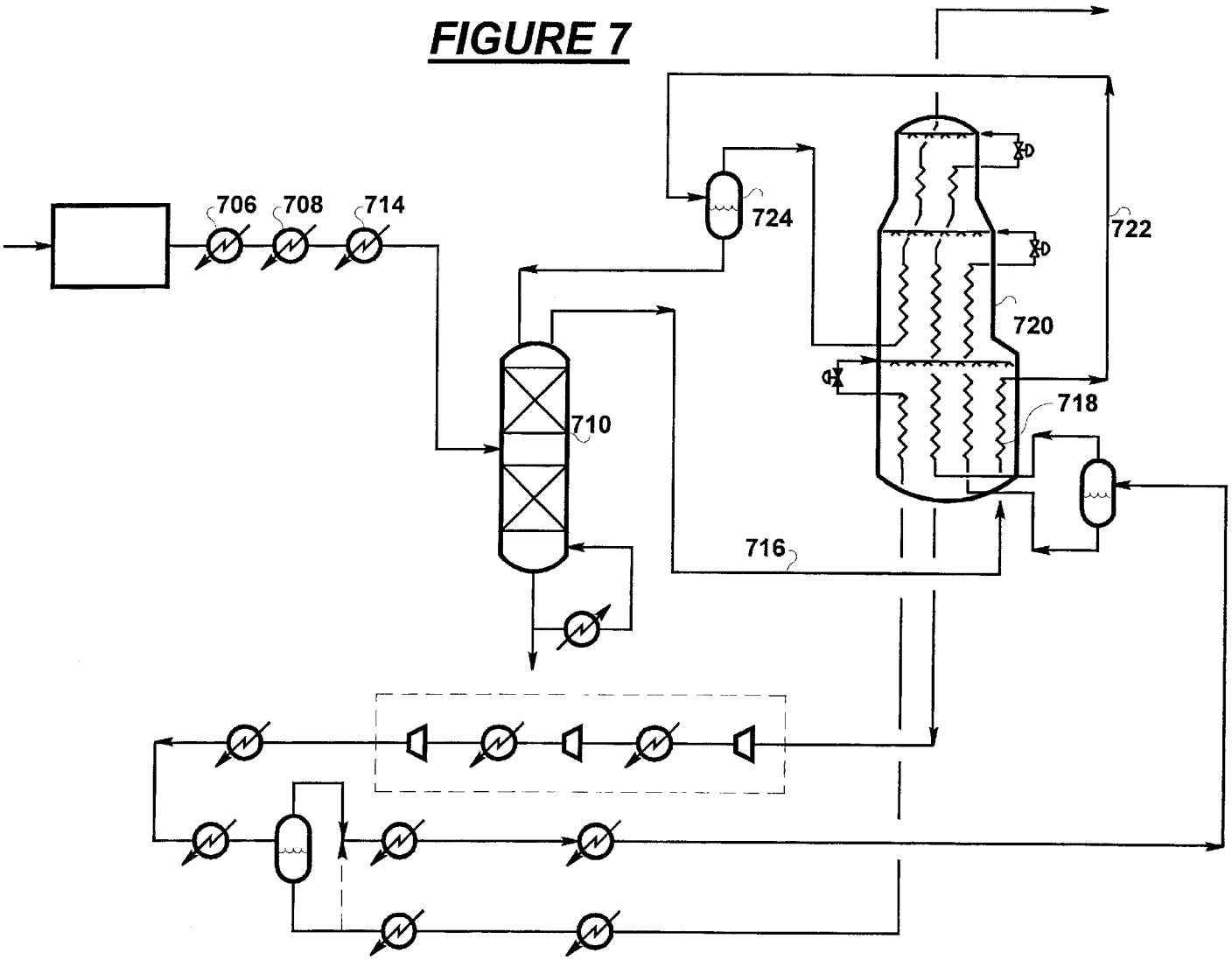
FIG. 7 is a schematic flow diagram of another embodiment of the present invention in which the feed gas is precooled in three stages of heat exchange with a second refrigerant.

FIG. 7 illustrates another embodiment of the invention in which all stages of feed precooling occur in propane exchangers 706, 708, and 714 prior to scrub column 710. Refrigeration for the overhead condenser of the scrub column is provided by cooling overhead stream 716 in cooling circuit 718 in the warmest zone of heat exchanger 720. Cooled and partially condensed overhead stream 722 is returned to scrub column separator 724. This embodiment is useful when very low levels of heavy components are required in the final LNG product.

Figure 8:
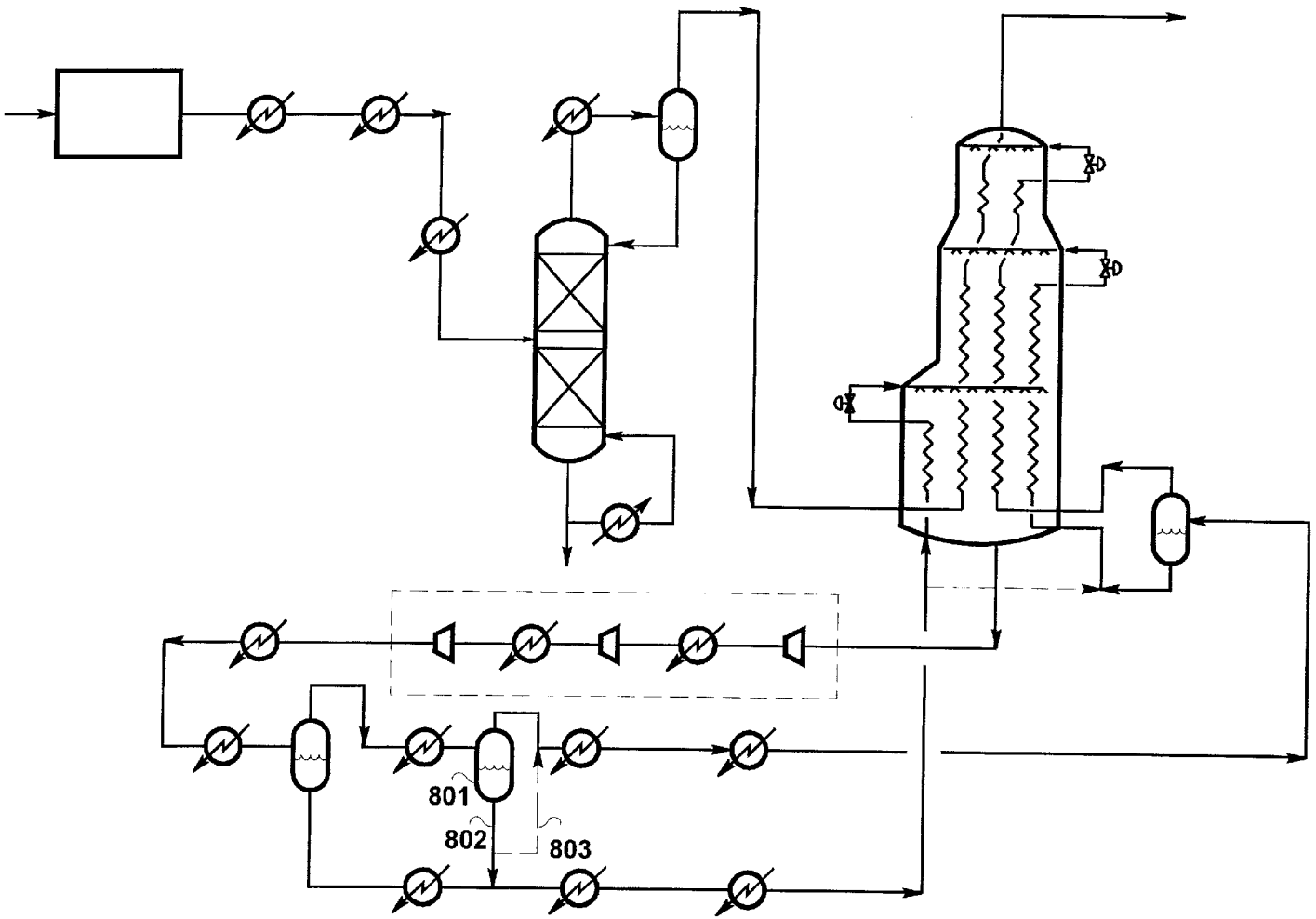
FIG. 8 is a schematic flow diagram of another embodiment of the present invention which utilizes two stages of partial condensation of the compressed mixed refrigerant to produce a combined liquid mixed refrigerant stream.

Another embodiment is illustrated in FIG. 8 wherein an additional mixed refrigerant liquid stream 802 is generated before the final propane precooling stage by means of additional separator 801. All or a portion of additional liquid stream 802 may be mixed with the first liquid generated after subcooling to the same temperature, and optionally a portion as stream 803 may be combined with the vapor from separator 801.

Figure 9:
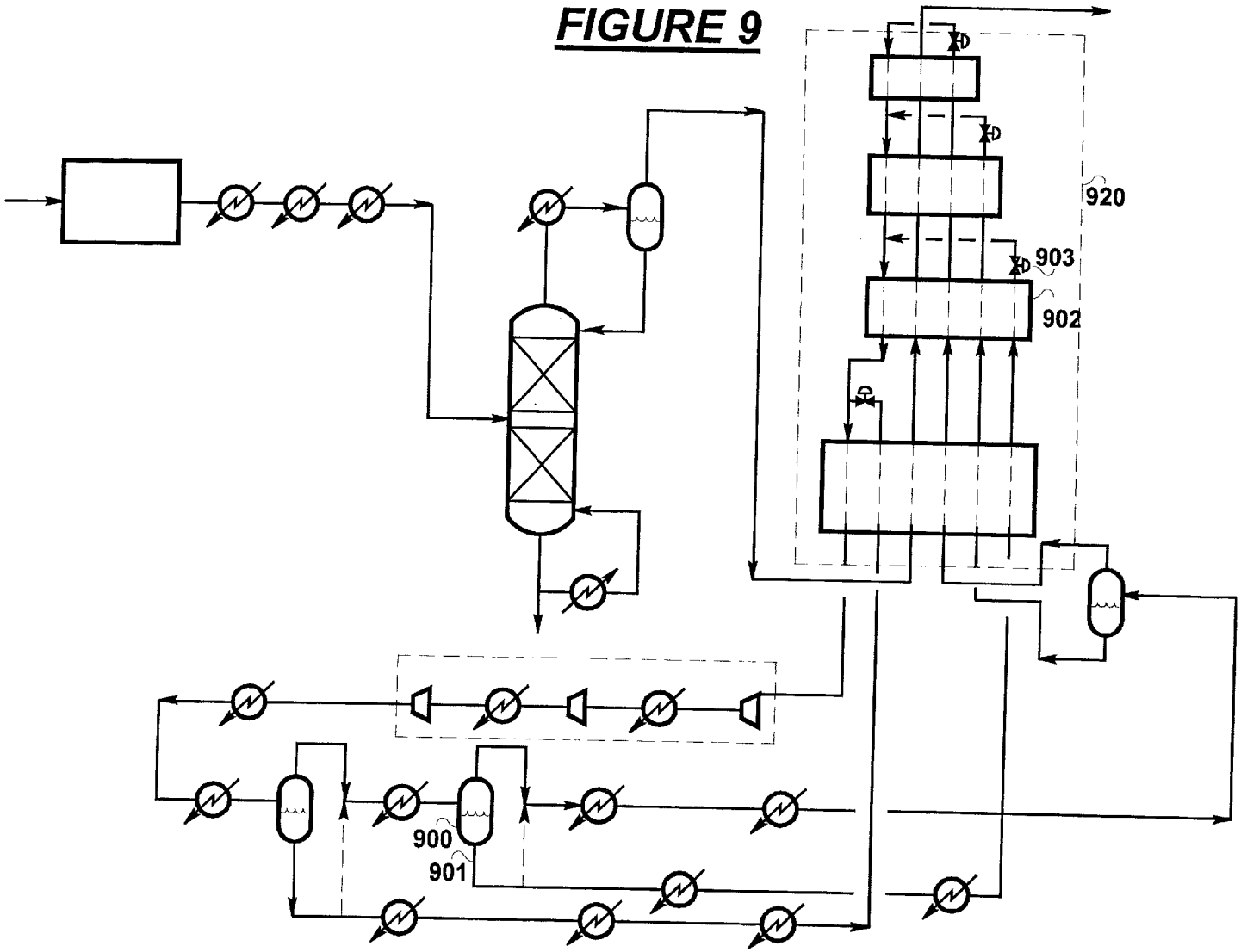
FIG. 9 is a schematic flow diagram of another embodiment of the present invention which utilizes two stages of partial condensation of the compressed mixed refrigerant to provide two subcooled liquid refrigerants to the main heat exchange zone.

FIG. 9 illustrates another embodiment of the invention in which a second additional liquid stream 901 is generated before the final propane stage by means of additional separator 900. In this embodiment, second additional liquid stream 901 generated is not mixed with the first liquid generated as was the case in the above embodiment of FIG. 8, but instead is subcooled and introduced into exchanger 920 as a liquid feed which is subcooled and expanded through throttling valve 903. The use of this additional liquid requires additional heat exchanger 902 as shown in FIG. 9. This embodiment differs from other embodiments in that brazed aluminum heat exchangers can be used in main heat exchange zone 920 as shown in FIG. 9, rather than the wound coil heat exchangers widely used in gas liquefaction processes. However, any suitable type of heat exchanger can be used for any embodiment of the present invention.

Figure 10:
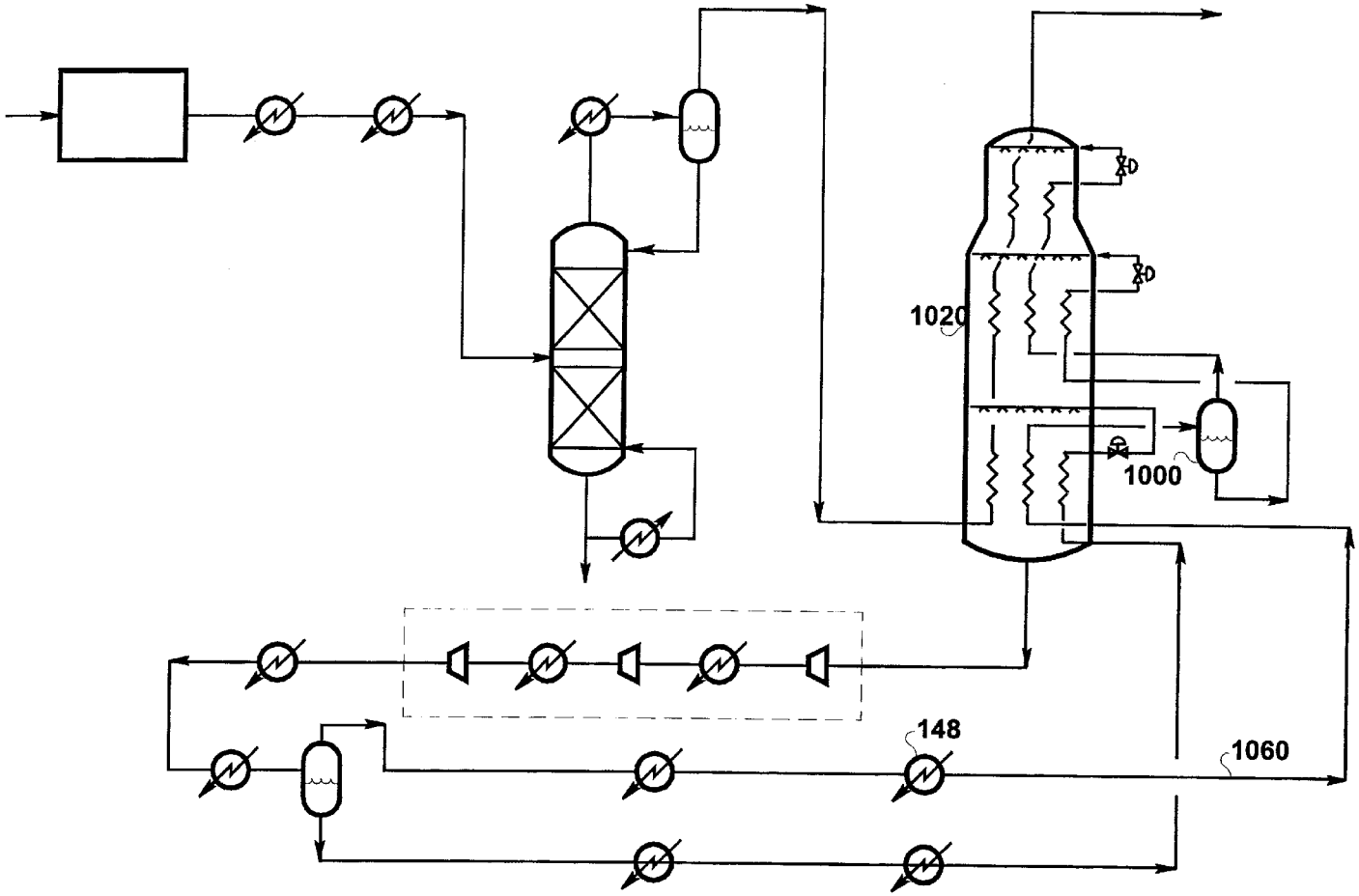
FIG. 10 is a schematic flow diagram of another embodiment of the present invention which utilizes two stages of partial condensation of the compressed mixed refrigerant, the second stage of which utilizes refrigeration provided by mixed refrigerant in the main heat exchange zone.

Another optional embodiment of the invention is given in FIG. 10. In this embodiment, the second phase separator 1000 is located at a colder temperature than that provided by the final propane precooling stage 148. Two phase stream 1060 enters exchanger 1020 directly and is cooled in the warmest heat exchange zone of the exchanger before being separated.

Figure 11:
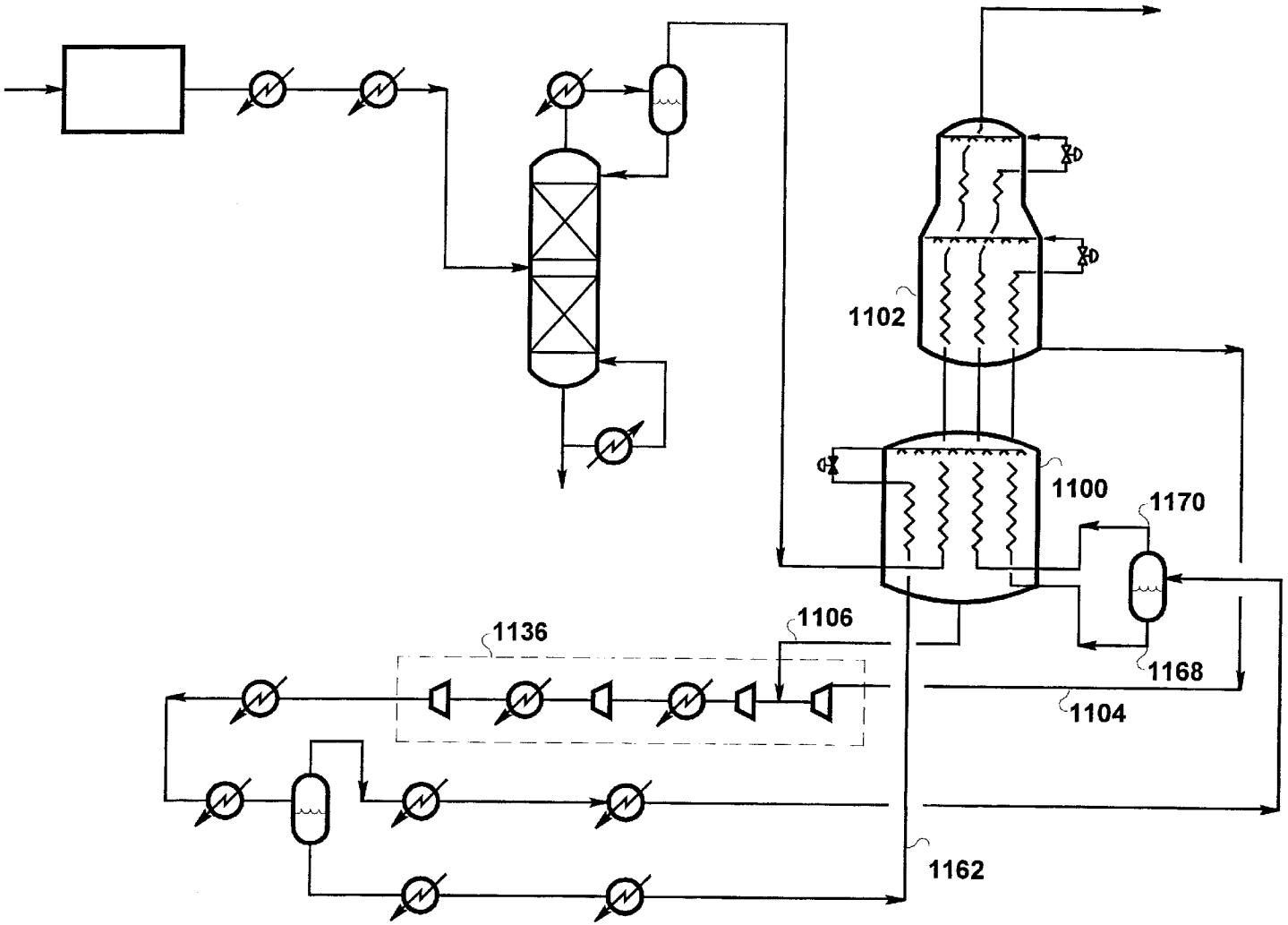
FIG. 11 is a schematic flow diagram of another embodiment of the present invention in which the mixed refrigerant is vaporized at two different pressures in the main heat exchange zone.

FIG. 11 discloses another feature of the invention wherein the mixed refrigerant streams are vaporized at two different pressures. Streams 1168 and 1170 are liquefied, subcooled, reduced in pressure, and vaporized at a low pressure in exchanger 1102. Vaporized mixed refrigerant stream 1104 may be fed cold directly to compressor 1136, or may be warmed in exchanger 1100 before being fed to compressor 1136. Liquid refrigerant stream 1162 is further subcooled, reduced in pressure to a pressure above the pressure in exchanger 1102, vaporized in exchanger 1100, and returned as stream 1106 to compressor 1136 between compression stages as shown.

Figure 12:
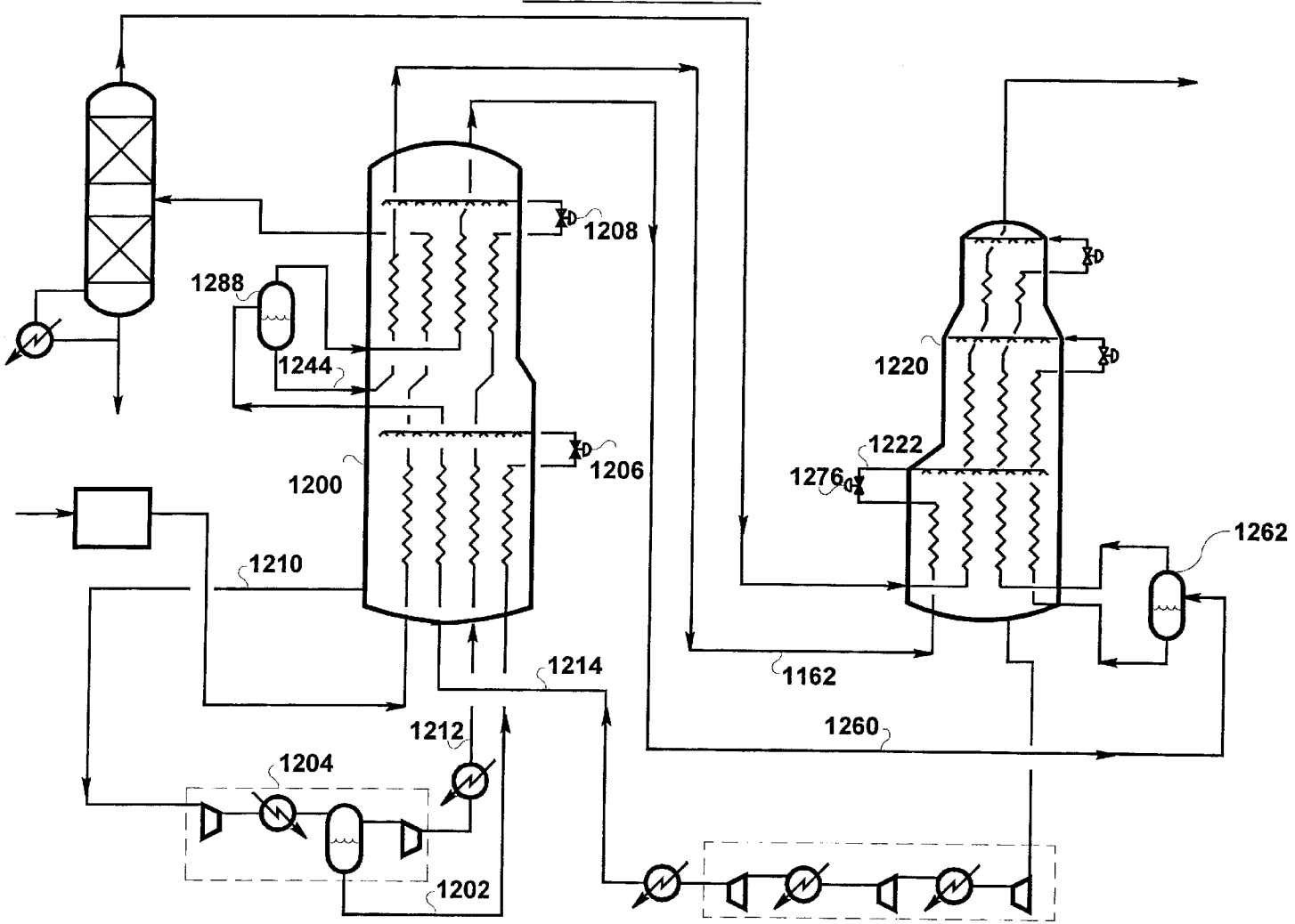
FIG. 12 is a schematic flow diagram of another embodiment of the present invention in which precooling is provided by a mixed refrigerant circuit.

The mixed refrigerant utilized for gas liquefaction may be precooled by another mixed refrigerant rather than by propane as described above. In this embodiment as shown in FIG. 12, liquid refrigerant stream 1202 is obtained from the partial condensation of a precooling mixed refrigerant between compression stages in compressor 1204. This liquid is then subcooled in exchanger 1200, withdrawn at an intermediate location, flashed across throttling valve 1206, and vaporized to provide the refrigeration to the warm zone of heat exchanger 1200. Vapor 1210 from exchanger 1200 is compressed in compressor 1204, cooled against an ambient temperature heat sink, and introduced to exchanger 1200 as stream 1212. Stream 1212 is cooled and subcooled in exchanger 1200, withdrawn at the cold end of 1200, flashed across throttling valve 1208, and vaporized to provide the refrigeration to the cold zone of exchanger 1200.

Compressed mixed refrigerant stream 1214 is cooled and partially condensed in the bottom portion of heat exchanger 1200, and then is separated in separator 1288. The resulting liquid stream 1244 is then subcooled in the upper end of exchanger 1200, the resulting subcooled stream 1162 is further subcooled in the bottom section of exchanger 1220, reduced in pressure adiabatically across throttling valve 1276, introduced via line 1222 into exchanger 1220, and vaporized to provide refrigeration therein. Vapor from separator 1288 is cooled in the top section of exchanger 1200 to provide two-phase refrigerant stream 1260, which is separated in separator 1262 and utilized in exchanger 1220 as earlier described.

Figure 13:
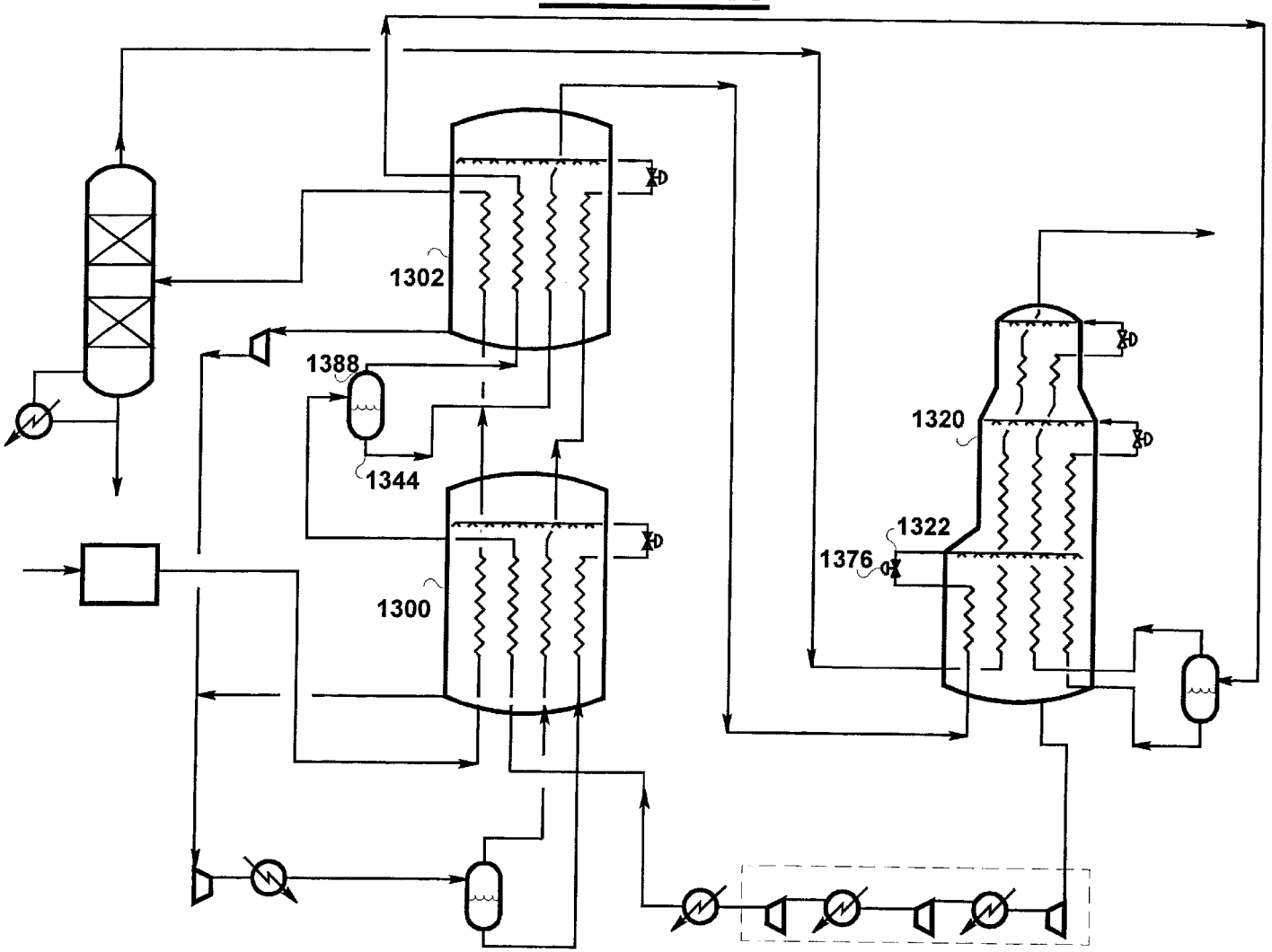
FIG. 13 is a schematic flow diagram of another embodiment of the present invention in which precooling is provided by a mixed refrigerant circuit with two refrigerant pressure levels.

FIG. 13 illustrates a modification to the embodiment of FIG. 12 wherein the precooling mixed refrigerant is vaporized at two different pressures in exchangers 1300 and 1302. The first separation of the cold mixed refrigerant in separator 1388 occurs after cooling in precooling exchanger 1300. The resulting liquid stream 1344 is then subcooled before being reduced in pressure adiabatically across throttling valve 1376 and introduced to exchanger 1320 as stream 1322 to provide refrigeration by vaporization therein.

Figure 14:
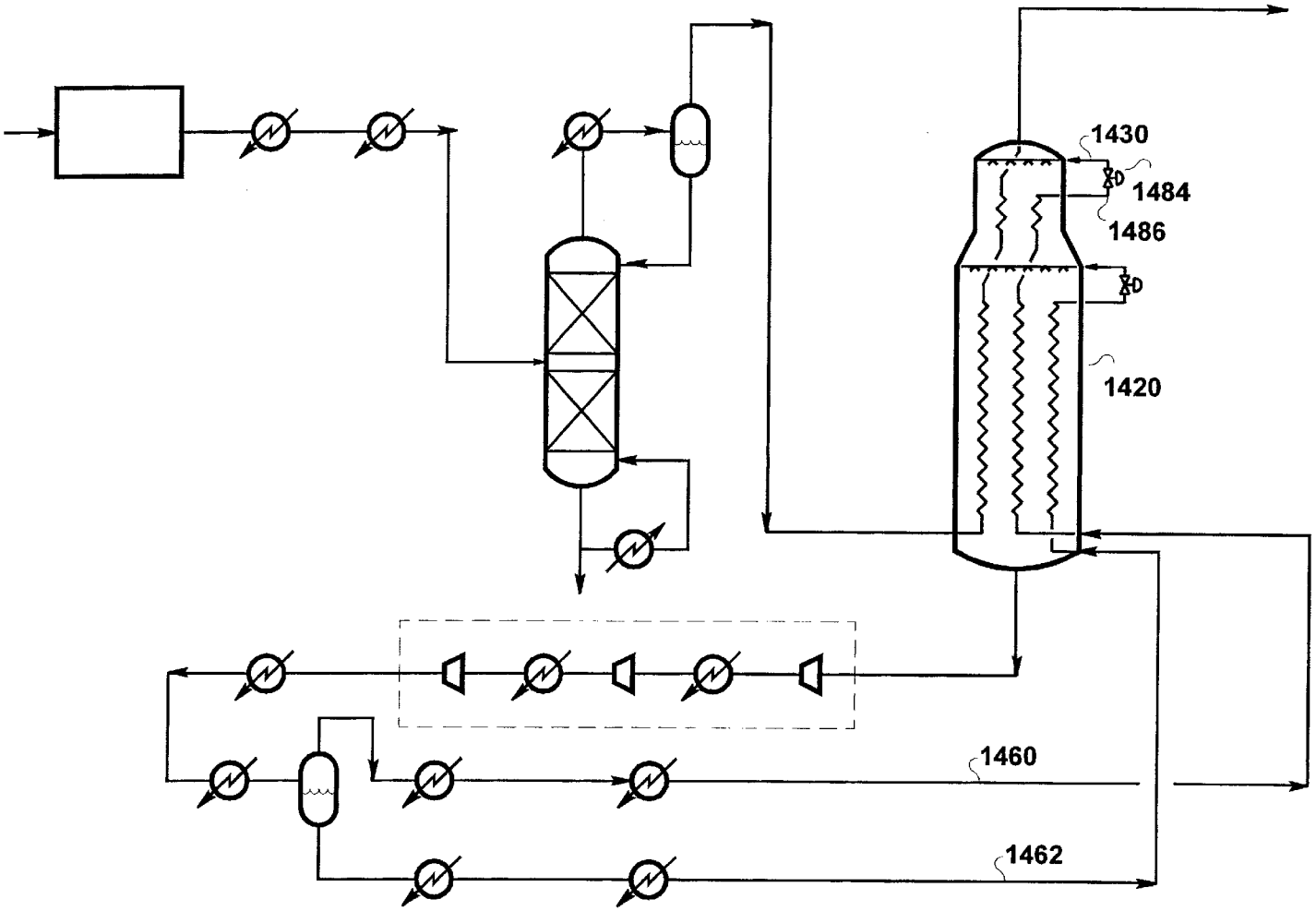
FIG. 14 is a schematic flow diagram of another embodiment of the present invention which utilizes a single stage of mixed refrigerant partial condensation.

A final embodiment of the invention is illustrated in FIG. 14, which is a simplified version of the embodiment of FIG. 2. In this embodiment, the flowsheet is simplified by eliminating the separation of stream 160 just prior to heat exchanger 220 of FIG. 2. In FIG. 14, the two heat exchange zones in exchanger 1420 replace the three heat exchange zones of heat exchanger 220 of FIG. 2. Stream 1460 is liquefied and subcooled in exchanger 1420, subcooled stream 1486 is reduced in pressure adiabatically across throttling valve 1484 to a pressure of about 3 bara, and is introduced as stream 1430 into the cold end of exchanger 1420 where it vaporizes to provide refrigeration. If desired, the pressure of stream 1486 could be reduced by work expansion in a turboexpander or expansion engine.

The embodiments described above utilize an important common feature of the present invention wherein at least one intermediate liquid stream is derived from the partial condensation and separation of the mixed refrigerant at a temperature equal to or greater than the lowest temperature achievable by cooling against the first recirculating refrigeration circuit. The intermediate liquid stream is used to provide refrigeration at a temperature lower than that provided by the precooling system.

The condensation temperature at which the intermediate stream is obtained can be varied as required; in the embodiment of FIG. 6 this condensation is effected at ambient temperature in heat exchanger 164, while in the embodiment of FIG. 3 the condensation is effected at the lowest propane precooling temperature in heat exchanger 304 at a pressure lower than the final highest pressure of the compressed mixed refrigerant vapor from compressor 306. Condensation is effected at temperatures between these extremes in the embodiments of FIGS. 2, 4, and 5.

The embodiments described above can be summarized in generic process terms as follows. The invention is basically a method for providing refrigeration to liquefy a feed gas which comprises several general steps. Refrigeration is provided by a first recirculating refrigeration circuit which provides refrigeration in a temperature range between a first temperature and a second temperature which is lower than the first temperature, and is described as precooling refrigeration. The second temperature is typically the lowest temperature to which a process stream can be cooled by indirect heat exchange with the refrigerant in the first refrigeration circuit. For example, if the first refrigeration circuit uses propane, the lowest temperature to which a process stream can be cooled is about −35° C., and this is typical of the second temperature.

Additional refrigeration is provided by a second recirculating refrigeration circuit in a temperature range between the second temperature and a third temperature which is lower than the second temperature. The first refrigeration circuit provides at least a portion of the refrigeration to the second refrigeration circuit in the temperature range between the first temperature and the second temperature, and also may provide refrigeration to precool the feed gas.

The first refrigeration circuit, which may utilize a single component or multiple components as described above, provides refrigeration at several temperature levels depending upon the pressure at which the refrigerant is vaporized. This first refrigeration circuit provides refrigeration for precooling the feed gas in exchangers 106, 108, 114, 401, 706, 708, 714, 1200, 1300, and 1302 as described above. The first refrigeration circuit also provides refrigeration to cool the second refrigerant circuit in exchangers 238, 246, 248, 250, 252, 300, 302, 304, 312, 402, 403, and 500 as described above.

The second refrigerant circuit, as exemplified in the preferred embodiment of FIG. 2, typically comprises refrigerant line 233, compressor 234, separator 240, the several cooling exchangers which provide cooling from the first refrigerant circuit, refrigerant lines 260, 262, 270, and 274, separator 272, subcooling circuits 275, 278, and 282, throttling valves 276, 280, and 284, and refrigerant lines 222, 224, 226, 227, 230, and 231. Similar components are utilized in similar fashion in the embodiments of FIGS. 4–13. The second refrigerant circuit in the embodiment of FIG. 14 includes features of FIG. 2 but without separator 272, refrigerant line 274, subcooling circuit 278, refrigerant lines 226 and 227, and throttling valve 280.

When the mixed refrigerant vapor is compressed to a final highest pressure in multistage compressor 234 of FIG. 2 (and similarly in the embodiments of FIGS. 4–13), the compressed vapor is partially condensed and separated at temperatures greater than the lowest temperature provided by refrigerant from the first refrigerant circuit. At least one of the mixed refrigerant vapor and liquid streams produced in the condensation/separation step is further cooled by refrigerant from the first refrigerant circuit to the lowest temperature possible using the first refrigerant. Such additional cooling can be provided by exchangers 246, 248, 250, and 252 of FIG. 2.

When the mixed refrigerant vapor is initially compressed to a pressure less than the final highest pressure, as in the embodiment of FIG. 3, condensation of the compressed mixed refrigerant vapor stream is effected between the stages of compressor 306 at a temperature equal to or higher than the lowest temperature achievable by cooling with refrigeration from the first refrigeration circuit, i.e., the second temperature. The separated vapor in line 310 is further compressed in a final stage of compressor 306. If no additional cooling is provided from the first refrigeration circuit in exchanger 312, condensation and separation of stream 308 could be carried out above the second temperature. If additional cooling is provided in exchanger 312, condensation and separation of stream 308 could be carried out at or above the second temperature.

The liquid refrigerant stream generated as described above, which is at or above the second temperature, is subcooled against vaporizing mixed refrigerant in the main heat exchanger, reduced in pressure, and vaporized in the main exchanger to provide refrigeration between the second temperature and the third temperature.

EXAMPLE

The preferred embodiment of the invention was simulated by performing heat and material balances for liquefying natural gas. Referring to FIG. 2 natural gas 100 is first cleaned and dried in pretreatment section 102 for the removal of acid gases such as $CO_2$ and $H_2S$ along with other contaminants such as mercury. Pretreated feed gas 104 has a flow rate of 30,611 kg-mole/hr, a pressure of 66.5 bara, and a temperature of 32° C. (89.6° F.) with a molar composition as follows:

TABLE 1

| Feed Gas Composition, Mole Fraction | |
|---|---|
| Nitrogen | 0.009 |
| Methane | 0.8774 |
| Ethane | 0.066 |
| Propane | 0.026 |
| i-Butane | 0.007 |
| Butane | 0.008 |
| i-Pentane | 0.002 |
| Pentane | 0.002 |
| Hexane | 0.001 |
| Heptane | 0.001 |

Pre-treated gas 104 enters first exchanger 106 and is cooled to a temperature of 9.3° C. by propane boiling at 5.9 bara. The feed is further cooled to −14.1° C. in exchanger 108 by propane boiling at 2.8 bara before entering scrub column 110 as stream 112. The overhead condenser 114 of the scrub column operates at −37° C. and is refrigerated by propane boiling at 1.17 bara. In scrub column 110 the pentane and heavier components of the feed are removed.

Natural gas stream 118, after heavy component removal and cooling to −37° C., is then further cooled in cooling circuit 219 in the first zone of main heat exchanger 220 to a temperature of −94° C. by boiling mixed refrigerant. The vaporized mixed refrigerant stream 233 has a flow of 42,052 kg-mole/hr and the following composition:

TABLE 2

| Mixed Refrigerant Composition (Mole Fraction) | |
|---|---|
| Nitrogen | 0.092 |
| Methane | 0.397 |
| Ethane | 0.355 |
| Propane | 0.127 |
| i-Butane | 0.014 |
| Butane | 0.014 |

The resulting feed gas is then further cooled in cooling circuit 225 to a temperature of about −128° C. in the second zone of exchanger 220 by boiling mixed refrigerant stream via lines 226 and 227. The resulting gas stream is further cooled in cooling circuit 228 to a temperature of −163° C. in a third zone of exchanger 220 by boiling mixed refrigerant stream introduced via lines 230 and 231. The resulting further cooled LNG stream 232 is then sent to a storage tank.

Refrigeration to cool the natural gas stream 118 from −37° C. to a temperature of −163° C. is provided by a mixed component refrigeration circuit. Stream 235 is the high pressure mixed refrigerant exiting multistage compressor 234 at a pressure of 51 bara. It is then cooled to 32° C. against cooling water in exchanger 236. High pressure mixed refrigerant stream 237 enters first stage propane exchanger 238, is cooled to a temperature of 9.3° C. by propane boiling at 5.9 bara, and flows into separator 240 where it is separated into vapor and liquid streams 242 and 244 respectively. Vapor stream 242 is further cooled in propane exchanger 246 to a temperature of −14.1° C. by propane boiling at 2.8 bara followed by propane exchanger 248 where it is further cooled to −37° C. by propane boiling at 1.17 bara. Liquid stream 244 at a flow rate of 9240 kg-mole/hr is further cooled in propane exchanger 250 to a temperature of −14.1° C. by propane boiling at 2.8 bara followed by propane exchanger 252 where it is further cooled to −37° C. by propane boiling at 1.17 bara.

The resulting cooled vapor stream 260 is then separated at −37° C. into liquid and vapor streams 268 and 270 respectively in separator 272. Liquid stream 268 has a flow rate of 17,400 kg-mole/hr.

Subcooled liquid stream 262 is further subcooled to a temperature of −94° C. in cooling circuit 275 and is reduced in pressure adiabatically across throttling valve 276 to a pressure of about 3 bara and introduced to exchanger 220 via lines 222 and 224. Liquid stream 274 is subcooled to a temperature of −128° C. in cooling circuit 278 and is reduced in pressure adiabatically across throttling valve 280 to a pressure of about 3 bara and introduced to exchanger 220 via lines 226 and 227. Vapor stream 270 is liquefied and subcooled to a temperature of −163° C. in cooling circuit 282, is reduced in pressure adiabatically across throttling valve 284 to a pressure of about 3 bara, and is introduced to the cold end exchanger 220 via lines 230 and 231.

The present invention in its broadest embodiment thus offers an improvement to the gas liquefaction art by generating at least one intermediate liquid stream derived from the partial condensation and separation of the mixed refrigerant at a temperature warmer than the lowest temperature provided by the precooling system or at a pressure lower than the final highest pressure of the mixed refrigerant circuit. This intermediate liquid mixed refrigerant stream is used at least in part to provide additional refrigeration at a temperature lower than that provided by the precooling system, and this additional refrigeration may be used in the main heat exchanger. The present invention is a more efficient process which provides increased LNG production for a given compression power compared with prior art processes.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A method for providing refrigeration for liquefying a feed gas which comprises:

(1) providing refrigeration from a first recirculating refrigeration circuit which provides refrigeration in a temperature range between a first temperature and a second temperature which is lower than the first temperature;

(2) providing refrigeration from a second recirculating refrigeration circuit in a temperature range between the second temperature and a third temperature which is lower than the second temperature, wherein the first refrigeration circuit provides refrigeration to the second refrigeration circuit in the temperature range between the first temperature and the second temperature;

(3) withdrawing a mixed refrigerant vapor from a main heat exchange zone in the second recirculating refrigeration circuit and compressing the mixed refrigerant vapor to a final highest pressure to yield a compressed mixed refrigerant vapor;

(4) partially condensing at least a portion of the compressed mixed refrigerant vapor in the second recirculating refrigeration circuit and separating the resulting partially condensed mixed refrigerant into at least one liquid refrigerant stream and at least one vapor refrigerant stream; and (5) subcooling the at least one liquid refrigerant stream to a temperature lower than the second temperature, reducing the pressure of the resulting subcooled liquid refrigerant stream, and vaporizing the resulting reduced-pressure refrigerant stream to provide at least a portion of the refrigeration for liquefying the feed gas between the second temperature and the third temperature;

wherein the step of partially condensing the compressed mixed refrigerant vapor is effected at a pressure essentially equal to the final highest pressure.

2. The method of claim 1 wherein refrigeration for liquefying the feed gas between the second temperature and the third temperature is provided by indirect heat exchange with a vaporizing mixed refrigerant in the main heat exchange zone, and wherein the vaporizing mixed refrigerant is provided by (a) compressing the mixed refrigerant vapor to a first pressure;

(b) cooling, partially condensing, and separating the resulting compressed refrigerant vapor to yield a first mixed refrigerant vapor fraction and a first mixed refrigerant liquid fraction;

(c) subcooling the first mixed refrigerant liquid fraction to provide a first subcooled mixed refrigerant liquid;

(d) reducing the pressure of the first subcooled mixed refrigerant liquid and vaporizing the resulting reduced pressure mixed refrigerant liquid in the main heat exchange zone to provide vaporizing mixed refrigerant for cooling and condensing the feed gas therein; and (e) withdrawing a vaporized mixed refrigerant stream from the main heat exchange zone to provide at least a portion of the mixed refrigerant vapor for step (a).

3. The method of claim 2 wherein at least a portion of the refrigeration for the subcooling in step (c) is provided by the vaporizing of the reduced pressure mixed refrigerant in the main heat exchange zone in step (d).

4. The method of claim 2 wherein at least a portion of the refrigeration for the subcooling in (c) is provided by indirect heat exchange with one or more additional refrigerant streams external to the main heat exchange zone.

5. The method of claim 4 wherein the one or more additional refrigerant streams comprises a single component refrigerant.

6. The method of claim 4 wherein the one or more additional refrigerant streams comprises a multicomponent refrigerant.

7. The method of claim 2 which further comprises partially condensing and separating the first mixed refrigerant vapor fraction to yield a second mixed refrigerant vapor and a second mixed refrigerant liquid, subcooling the second mixed refrigerant liquid by indirect heat exchange with vaporizing mixed refrigerant in the main heat exchange zone, reducing the pressure of the resulting subcooled second mixed refrigerant liquid, and vaporizing the resulting reduced pressure mixed refrigerant stream in the main heat exchange zone to provide additional vaporizing mixed refrigerant therein.

8. The method of claim 7 which further comprises condensing and subcooling the second mixed refrigerant vapor by indirect heat exchange with vaporizing mixed refrigerant in the main heat exchange zone, reducing the pressure of the resulting condensed and subcooled second mixed refrigerant vapor, and vaporizing the resulting reduced-pressure mixed refrigerant stream in the main heat exchange zone to provide additional vaporizing mixed refrigerant therein.

9. The method of claim 7 wherein a portion of the refrigeration for cooling and partially condensing the first mixed refrigerant vapor fraction is provided by indirect heat exchange with vaporizing mixed refrigerant in the main heat exchange zone.

10. The method of claim 7 wherein the first pressurized mixed refrigerant liquid after subcooling is vaporized in the main heat exchange zone at a first pressure; and the second pressurized mixed refrigerant liquid after subcooling is vaporized in the main heat exchange zone at a second pressure.

11. The method of claim 10 which further comprises condensing and subcooling the second mixed refrigerant vapor by indirect heat exchange with vaporizing mixed refrigerant in the main heat exchange zone, reducing the pressure of the resulting condensed and subcooled second mixed refrigerant vapor to the second pressure, and vaporizing the resulting reduced pressure mixed refrigerant liquid in the main heat exchange zone to provide additional vaporizing mixed refrigerant therein.

12. The method of claim 2 wherein at least a portion of the refrigeration for the cooling and partial condensing in (b) is provided by indirect heat exchange with one or more additional refrigerant streams external to the main heat exchange zone.

13. The method of claim 12 wherein at least one of the one or more additional refrigerant streams comprises a single component refrigerant.

14. The method of claim 12 wherein at least one of the one or more additional refrigerant streams comprises a multicomponent refrigerant.

15. The method of claim 2 wherein a portion of the refrigeration for cooling the feed gas is provided by indirect heat exchange with one or more additional refrigerant streams external of the main heat exchange zone.

16. The method of claim 15 wherein the one or more additional refrigerant streams comprises a single component refrigerant.

17. The method of claim 15 wherein the one or more additional refrigerant streams comprises a multicomponent refrigerant.

18. The method of claim 2 wherein the feed gas comprises methane and one or more hydrocarbons heavier than methane, and wherein the method further comprises:

(e) precooling the feed gas by indirect heat exchange with an additional refrigerant stream;

(f) introducing the resulting precooled feed gas into a scrub column with a lean scrub liquid enriched in hydrocarbons heavier than methane;

(g) withdrawing from the bottom of the scrub column a stream rich in hydrocarbons heavier than methane;

(h) withdrawing from the top of the scrub column an overhead stream containing methane and residual hydrocarbons heavier than methane;

(i) cooling the overhead stream in the main heat exchange zone to condense residual hydrocarbons heavier than methane;

(j) separating the resulting cooled overhead stream into a purified methane-enriched product and a stream enriched in hydrocarbons heavier than methane; and (k) utilizing at least a portion of the stream enriched in hydrocarbons heavier than methane to provide the lean scrub liquid of (f).

19. The method of claim 2 wherein the cooling and partially condensing of the resulting compressed first mixed refrigerant vapor in (b) is effected by indirect heat exchange with a fluid at ambient temperature.

20. The method of claim 2 wherein a portion of the first mixed refrigerant liquid is mixed with the first pressurized mixed refrigerant vapor.

21. The method of claim 2 wherein further cooling, partially condensing, and separating of at least a portion of the first mixed refrigerant vapor in (b) yields an additional mixed refrigerant liquid which is combined with the first pressurized mixed refrigerant liquid.

22. The method of claim 1 wherein the operation of the second recirculating refrigeration circuit includes (a) compressing the mixed refrigerant vapor to a first pressure;

(b) cooling, partially condensing, and separating the resulting compressed refrigerant vapor to yield a mixed refrigerant vapor fraction and a mixed refrigerant liquid fraction;

(c) subcooling the mixed refrigerant liquid fraction to provide a subcooled mixed refrigerant liquid;

(d) reducing the pressure of the subcooled mixed refrigerant liquid and vaporizing the resulting reduced pressure mixed refrigerant liquid in the main heat exchange zone to provide one of the vaporizing mixed refrigerant streams for cooling and condensing the feed gas therein; and (e) withdrawing a vaporized mixed refrigerant stream from the main heat exchange zone to provide at least a portion of the mixed refrigerant vapor in (a);

wherein the refrigeration for subcooling the mixed refrigerant liquid fraction is provided in part by indirect heat exchange with the resulting vaporizing reduced pressure refrigerant liquid in the main heat exchange zone and in part by indirect heat exchange with one or more portions of an additional refrigerant external to the main heat exchange zone.

23. The method of claim 23 which further comprises (f) condensing and subcooling the mixed refrigerant vapor fraction to provide an additional subcooled mixed refrigerant liquid; and (g) reducing the pressure of the additional subcooled mixed refrigerant liquid and vaporizing the resulting reduced pressure liquid in the main heat exchange zone to provide another of the vaporizing mixed refrigerant streams for cooling and condensing the feed gas therein;

wherein the refrigeration for condensing and subcooling the additional mixed refrigerant vapor is provided in part by indirect heat exchange with the resulting vaporizing reduced pressure liquid in the main heat exchange zone and in part by indirect heat exchange with one or more additional refrigerant streams external to the main heat exchange zone.

* * * * *

UNITED STATES PATENT AND TRADEMARK OFFICE

CERTIFICATE OF CORRECTION

PATENT NO. : 6,347,532 B1
DATED : February 19, 2002
INVENTOR(S) : Agrawal et al.

It is certified that error appears in the above-identified patent and that said Letters Patent is hereby corrected as shown below:

Column 18,
Line 48, delete "23" and substitute therefor -- 22 --.

Signed and Sealed this

Thirteenth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,347,532 B1
DATED : February 19, 2002
INVENTOR(S) : Rakesh Agrawal et al.

It is certified that error appears in the above-identified patent and that said Letters Patent is hereby corrected as shown below:

Column 2,
Line 32, delete "temperatures" and substitute therefor -- temperature --

Column 17,
Line 58, delete "(e)" and substitute therefor -- (f) --
Line 60, delete "(f)" and substitute therefor -- (g) --
Line 63, delete "(g)" and substitute therefor -- (h) --
Line 65, delete "(h)" and substitute therefor -- (i) --

Column 8,
Line 1, delete "(i)" and substitute therefor -- (j) --
Line 4, delete "(j)" and substitute therefor -- (k) --
Line 7, delete "(k)" and substitute therefor -- (l) --
Line 9, delete "(f)" and substitute therefor -- (g) --

Signed and Sealed this

Third Day of June, 2003

JAMES E. ROGAN
*Director of the United States Patent and Trademark Office*